US007900923B2

(12) United States Patent
Toyama et al.

(10) Patent No.: US 7,900,923 B2
(45) Date of Patent: Mar. 8, 2011

(54) APPARATUS AND METHOD FOR AUTOMATICALLY SHUFFLING CARDS

(75) Inventors: Hirohide Toyama, Darien, IL (US); Keith D. Alsberg, Chicago, IL (US); Stephen C. Jones, Chicago, IL (US)

(73) Assignee: Shuffle Tech International LLC, Chicago, IL (US)

( * ) Notice: Subject to any disclaimer, the term of this patent is extended or adjusted under 35 U.S.C. 154(b) by 172 days.

(21) Appl. No.: 11/706,707

(22) Filed: Feb. 15, 2007

(65) Prior Publication Data

US 2007/0194524 A1 Aug. 23, 2007

Related U.S. Application Data

(60) Provisional application No. 60/775,260, filed on Feb. 21, 2006.

(51) Int. Cl.
*A63F 1/14* (2006.01)

(52) U.S. Cl. ..... 273/149 R; 273/148 R; 209/534; 209/547; 209/554

(58) Field of Classification Search ..... 273/149 R, 273/148 R; 209/534, 547, 554
See application file for complete search history.

(56) References Cited

U.S. PATENT DOCUMENTS

| | | | | | |
|---|---|---|---|---|---|
| 1,955,926 | A | * | 4/1934 | Matthaey | 273/149 R |
| 2,001,220 | A | * | 5/1935 | Smith | 273/149 R |
| 2,159,958 | A | * | 5/1939 | Sachs | 273/149 R |
| 2,430,681 | A | * | 11/1947 | Johnson | 473/470 |
| 2,706,117 | A | * | 4/1955 | Notz | 273/149 R |
| 2,711,319 | A | * | 6/1955 | Morgan et al. | 273/149 R |
| 2,714,510 | A | * | 8/1955 | Oppenlander et al. | 273/149 R |
| 2,717,782 | A | * | 9/1955 | Droll | 273/149 R |
| 2,727,747 | A | * | 12/1955 | Semisch, Jr | 273/149 R |
| 2,753,185 | A | | 7/1956 | Johnson | |
| 2,755,090 | A | * | 7/1956 | Aldrich | 273/149 R |
| 2,815,214 | A | * | 12/1957 | Hall | 273/149 R |

(Continued)

FOREIGN PATENT DOCUMENTS

JP 2001327647 A 11/2001

OTHER PUBLICATIONS

John N. Hansen Co., "Four Deck Automatic Card Shuffler," AreYouGame.com, obtained at the Internet address: http://www.areyougame.com/Interact/search.asp?qmethod=0&q=jhb232, 1 page.

(Continued)

*Primary Examiner* — Gene Kim
*Assistant Examiner* — Alexander R Niconovich
(74) *Attorney, Agent, or Firm* — Brinks Hofer Gilson & Lione

(57) ABSTRACT

An apparatus and method of automatically shuffling a deck of playing cards is described. The apparatus includes three compartments disposed laterally with respect to each other and at least one compartment movable vertically with respect to another other compartment. Cards placed in one of the compartments are dispensed into the other two compartments so as to cut or strip the deck, and are returned to the original compartment by interleaving cards from the other compartments. The process may be repeated to substantially randomize the deck for use in playing a game of cards. One of the compartments may be operable, either manually or by motive means so as to project outside the envelope of the apparatus so as to accept or dispense a deck of cards.

21 Claims, 16 Drawing Sheets

U.S. PATENT DOCUMENTS 3,067,885 A * 12/1962 Kohler ..... 414/796.6
3,147,978 A * 9/1964 Sjostrand ..... 273/149 R
3,305,237 A * 2/1967 Granius ..... 273/149 R
3,588,116 A * 6/1971 Miura ..... 273/149 R
3,589,730 A * 6/1971 Slay ..... 273/149 R
D224,658 S * 8/1972 Cole et al. ..... D21/393
3,975,010 A * 8/1976 Schisselbauer et al. ..... 271/4.1
4,310,160 A * 1/1982 Willette et al. ..... 273/149 R
4,497,488 A * 2/1985 Plevyak et al. ..... 273/149 R
4,513,969 A * 4/1985 Samsel, Jr. ..... 273/149 R
4,515,367 A * 5/1985 Howard ..... 273/149 R
4,586,712 A * 5/1986 Lorber et al. ..... 273/149 R
4,770,421 A * 9/1988 Hoffman ..... 273/149 R
4,807,884 A * 2/1989 Breeding ..... 273/149 R
4,832,342 A * 5/1989 Plevyak et al. ..... 273/149 R
4,951,950 A * 8/1990 Normand et al. ..... 273/149 P
4,969,648 A * 11/1990 Hollinger et al. ..... 273/149 R
5,000,453 A * 3/1991 Stevens et al. ..... 273/149 R
5,261,667 A * 11/1993 Breeding ..... 273/149 R
5,344,146 A * 9/1994 Lee ..... 273/149 R
5,356,145 A * 10/1994 Verschoor ..... 273/149 R
5,382,024 A * 1/1995 Blaha ..... 273/149 R
5,397,133 A * 3/1995 Penzias ..... 463/22
5,431,399 A * 7/1995 Kelley ..... 273/149 P
5,445,377 A * 8/1995 Steinbach ..... 273/149 R
5,575,475 A * 11/1996 Steinbach ..... 273/149 R
5,584,483 A * 12/1996 Sines et al. ..... 273/149 R
5,676,372 A * 10/1997 Sines et al. ..... 273/149 R
5,692,748 A * 12/1997 Frisco et al. ..... 273/149 R
5,695,189 A * 12/1997 Breeding et al. ..... 273/149 R
5,718,427 A * 2/1998 Cranford et al. ..... 273/149 R
5,944,310 A * 8/1999 Johnson et al. ..... 273/149 R
5,989,122 A * 11/1999 Roblejo ..... 463/22
6,019,368 A * 2/2000 Sines et al. ..... 273/149 R
6,068,258 A * 5/2000 Breeding et al. ..... 273/149 R
D432,588 S * 10/2000 Tedham ..... D21/396
6,139,014 A * 10/2000 Breeding et al. ..... 273/149 R
6,149,154 A * 11/2000 Grauzer et al. ..... 273/149 R
6,189,880 B1 * 2/2001 Besold ..... 270/58.25
6,250,632 B1 * 6/2001 Albrecht ..... 273/149 R
6,254,096 B1 * 7/2001 Grauzer et al. ..... 273/149 R
6,299,167 B1 * 10/2001 Sines et al. ..... 273/149 R
6,325,373 B1 * 12/2001 Breeding et al. ..... 273/149 R
6,568,678 B2 * 5/2003 Breeding et al. ..... 273/149 R
6,588,750 B1 * 7/2003 Grauzer et al. ..... 273/149 R
6,588,751 B1 * 7/2003 Grauzer et al. ..... 273/149 R
6,651,981 B2 * 11/2003 Grauzer et al. ..... 273/149 R
6,651,982 B2 * 11/2003 Grauzer et al. ..... 273/149 R
6,655,684 B2 * 12/2003 Grauzer et al. ..... 273/149 R
6,659,460 B2 * 12/2003 Blaha et al. ..... 273/149 R
6,676,127 B2 * 1/2004 Johnson et al. ..... 273/149 R
6,698,756 B1 * 3/2004 Baker et al. ..... 273/149 R
D488,193 S * 4/2004 Girard ..... D21/396
D490,481 S 5/2004 Hessing
6,886,829 B2 * 5/2005 Hessing et al. ..... 273/149 R
6,889,979 B2 * 5/2005 Blaha et al. ..... 273/149 R
6,959,925 B1 * 11/2005 Baker et al. ..... 273/149 R
7,066,464 B2 * 6/2006 Blad et al. ..... 273/149 R
7,264,140 B1 * 9/2007 Stoddard et al. ..... 221/310
7,413,191 B2 * 8/2008 Grauzer et al. ..... 273/149 R
D578,577 S * 10/2008 Toyama ..... D21/396
7,510,194 B2 * 3/2009 Soltys et al. ..... 273/293
7,523,935 B2 4/2009 Grauzer et al.
7,540,497 B2 * 6/2009 Tseng ..... 273/149 R
7,556,266 B2 7/2009 Blaha et al.
7,584,962 B2 * 9/2009 Breeding et al. ..... 273/149 R
7,677,565 B2 3/2010 Grauzer et al.
7,766,333 B1 * 8/2010 Stardust et al. ..... 273/149 R
2002/0063389 A1 * 5/2002 Breeding et al. ..... 273/292
2002/0070499 A1 * 6/2002 Breeding et al. ..... 273/149 R
2003/0073498 A1 4/2003 Grauzer et al.
2004/0108255 A1 * 6/2004 Johnson ..... 209/547
2004/0224777 A1 * 11/2004 Smith et al. ..... 463/47
2005/0110210 A1 * 5/2005 Soltys et al. ..... 273/149 P
2005/0140090 A1 * 6/2005 Breeding et al. ..... 273/149 R
2005/0206077 A1 * 9/2005 Grauzer et al. ..... 273/149 R
2007/0069462 A1 3/2007 Downs, III et al.
2007/0102879 A1 * 5/2007 Stasson ..... 273/149 R
2007/0194524 A1 * 8/2007 Toyama et al. ..... 273/149 R
2007/0273094 A1 * 11/2007 Fleckenstein ..... 273/149 P
2007/0273099 A1 * 11/2007 Fleckenstein ..... 273/309
2007/0278739 A1 * 12/2007 Swanson ..... 273/149 R
2008/0113700 A1 5/2008 Czyzewski et al.
2008/0284096 A1 * 11/2008 Toyama et al. ..... 273/149 R
2008/0315517 A1 12/2008 Toyama
2009/0072477 A1 * 3/2009 Tseng ..... 273/149 R
2009/0191933 A1 7/2009 French
2009/0243213 A1 10/2009 Pececnik et al.
2009/0283969 A1 * 11/2009 Tseng ..... 273/149 R

OTHER PUBLICATIONS

Home Casino Games, Online Gamblers Gift Shop, "Card Shufflers," obtained at the Internet address: http://www.homecasinogames.com/Catalog/ItemList.cfm?CategoryId=874, 2 pages.

Opamerica, Excalibur Electronics WSOP Pro Shuffle (425-WSOP), obtained at the Internet address: http://www.opamerica.com/product info.php/products_id/869, 1 page.

PCT Notification of Transmittal of the International Preliminary Report on Patentability from PCT International Application No. PCT/US2007/004509 dated Sep. 4, 2008 (7 pages).

International Search Report from PCT international application No. PCT/US2007/004509 dated Oct. 4, 2007 (4 pages).

Written Opinion of the International Searching Authority from the International Search Report from PCT application No. PCT/US2008/064628 dated Oct. 28, 2008, 5 pages.

International Search Report for International Application No. PCT/US2008/064628, dated Oct. 28, 2008, 3 pages.

Jul. 22, 2010 Non-Final Office Action, U.S. Appl. No. 12/151,358 (29 pages).

Response to Jul. 22, 2010 Non-Final Office Action, U.S. Appl. No. 12/151,358, filed in the PTO on Jan. 20, 2011 (23 pages).

* cited by examiner

SECTION A-A

SECTION B-B

SECTION C-C

APPARATUS AND METHOD FOR AUTOMATICALLY SHUFFLING CARDS

This application claims the benefit of U.S. provisional application Ser. No. 60/755,260, filed on Feb. 21, 2006, which is incorporated herein by reference.

TECHNICAL FIELD

This application relates to an apparatus and method for automatically preparing playing cards for use, and in particular for the cutting, riffling and stripping operations performed in a card game.

BACKGROUND

Various games are played using playing cards, where a typical game may use one or more decks, which may have 52 cards of various values and suits. Other card games may use different numbers of cards, and some games may be played with multiple decks of cards. Examples of such games are poker, blackjack, bridge, canasta, preference, pinochle and the like. Players of such games have an interest in ensuring that the playing cards are dispensed for the playing of a game in a random manner, giving no one player an unfair advantage. Preparing a deck of cards may be accomplished either manually or automatically. In the case of manual preparation, the cards may be cut, riffled and stripped. This process is generically termed "shuffling" the cards, and may be performed multiple times to prepare the deck. It is believed that performing a cut-riffle process approximately 7 times will result in a sufficiently random distribution of cards within a deck. However this is time consuming and, except in professional games, it is common to perform the shuffling process only 2-4 times. Various mechanical means of performing operations which may have the effect of randomizing the deck of cards are known. Such mechanical means may not replicate the actions of a dealer performing manual shuffling, or may be cumbersome to use and expensive, being typically intended for use in a casino.

SUMMARY

A device for shuffling a deck of cards is described, the device including a first compartment, a second compartment and a third compartment. Each compartment has a transport mechanism and the transport mechanism in the first compartment is operable to dispense cards from the first compartment to at least one of the second and third compartments, and the transport mechanism in at least one of the second and the third compartments is operable to dispense cards from at least one of the second and third compartments to the first compartment.

A method for shuffling a deck of cards is described, including the steps of providing a shuffling device and placing a deck of cards into a first compartment of the shuffling device; transferring a portion of the deck of cards from the first compartment into a second and a third compartment; and transferring the portions of the deck of cards from the second and third compartments to the first compartment, where the cards are returned to the first compartment such that, approximately, the cards are received by the first compartment alternately from the second and third compartments.

DETAILED DESCRIPTION

Exemplary embodiments may be better understood with reference to the drawings, but these examples are not intended to be of a limiting nature. Like numbered elements in the same or different drawings perform equivalent functions.

Figure 1A:
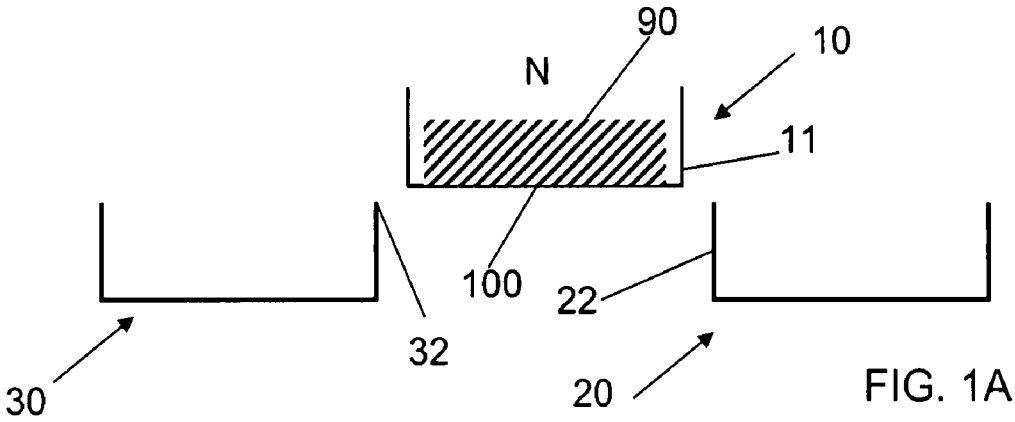
FIG. 1 A-C is a conceptual diagram showing a cut or split operation on a deck of cards.
Figure 1B:
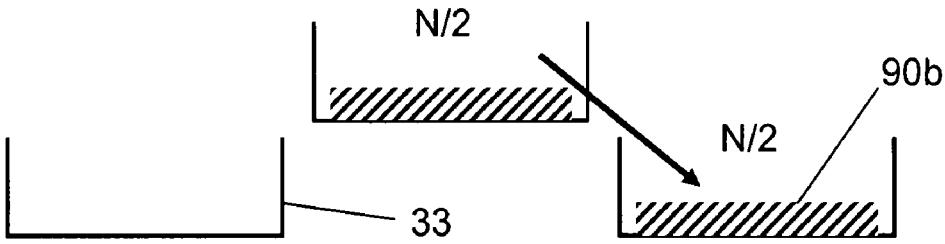
Figure 1C:
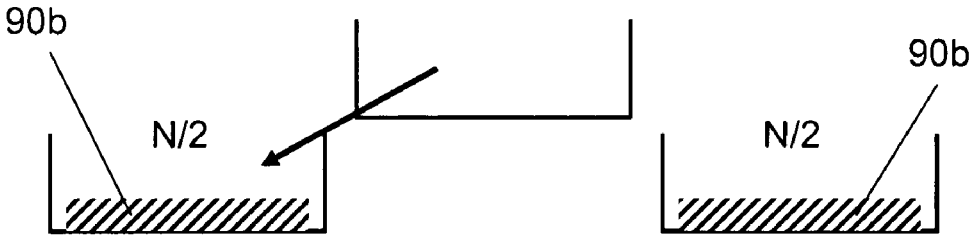
Figure 2A:
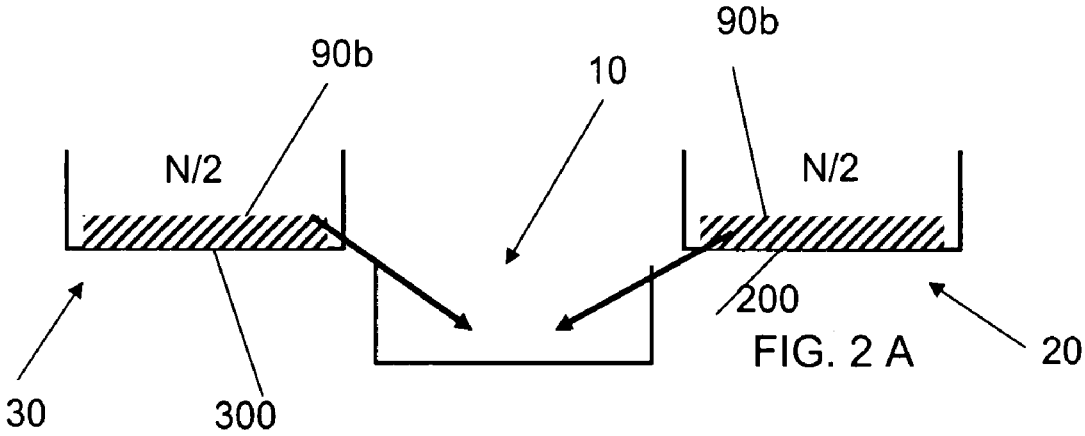
FIG. 2 A-B is a conceptual diagram showing a riffle operation on a deck of cards.
Figure 2B:
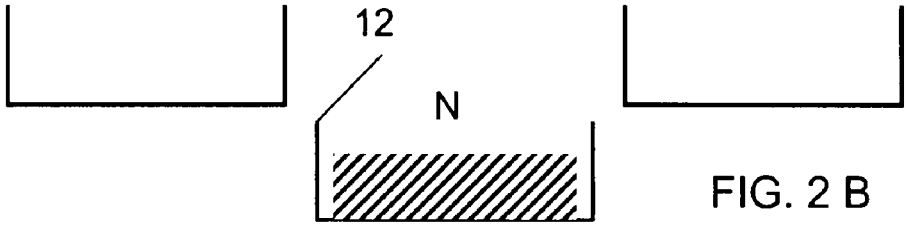
Figure 3A:
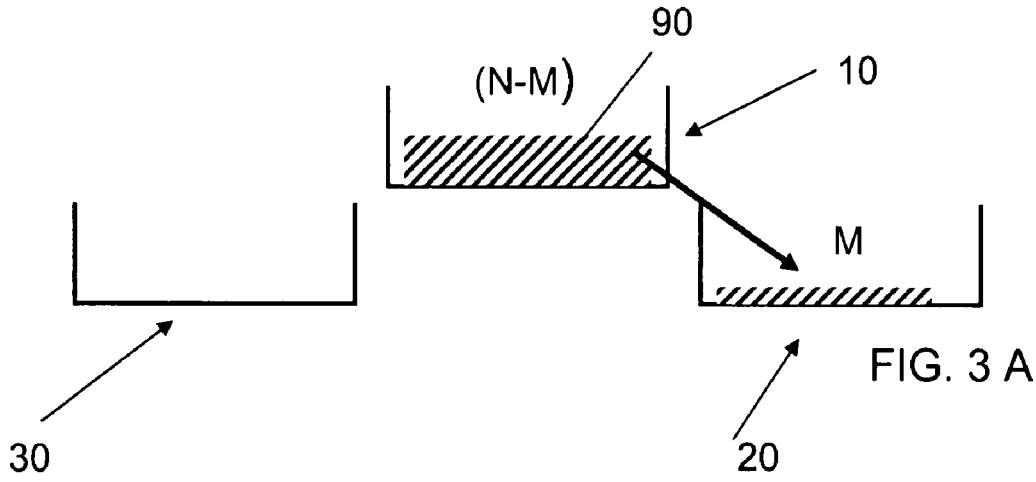
FIG. 3 A-C is a conceptual diagram showing a stripping operation on a deck of cards.
Figure 3B:
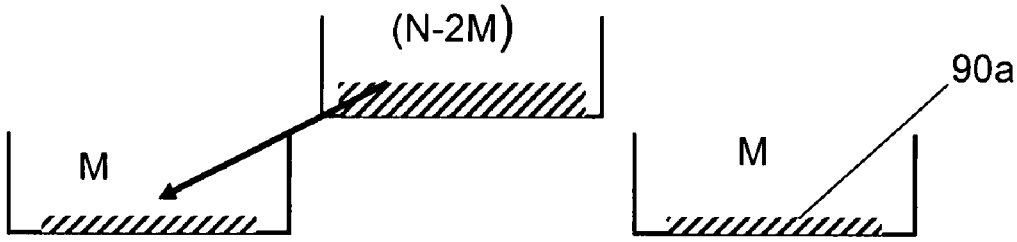
Figure 3C:
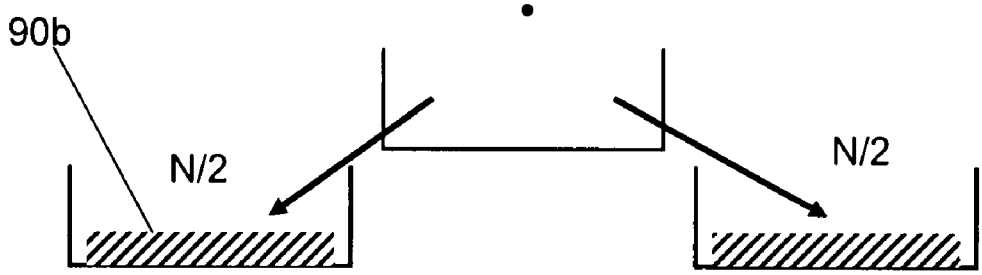

The terminology and general arrangement of the automatic card shuffling device is illustrated in FIGS. 1 through 3 in elevation cross-sectional views. The device may be intended for, and dimensioned for use with, a single deck of cards. Alternatively, the device may be dimensioned for use with multiple decks of cards, although a device dimensioned for multiple decks of cards may also be suitable for shuffling a single deck of cards. Generally, the difference between such configurations is the height of the compartments used to hold the cards. The subsequent discussion will describe a single deck of cards, for clarity; however, unless otherwise excluded, the operations are equally possible for a stack of cards comprising more than one deck of cards.

The operations performed by the device include:

(a) cutting or splitting: an operation by which a deck of cards is divided approximately into two portions or stacks of cards;

(b) riffling: an operation by which the two portions or stacks obtained by cutting the deck are recombined by approximately moving a card from each of the two portions into a resultant single stack, where the cards are moved alternately from each portion to a single stack;

(c) stripping: an operation similar to cutting, in which an approximately predetermined number of cards is moved from the initial stack to a first stack, a similar number of cards is moved to a second stack, and the process is repeated until the initial stack of cards has been completely moved to the first and second stacks.

Commonly, the performance of step (a) followed by steps (b), or step (c) followed by step (b), or the like, is termed "shuffling" the cards, and may be performed multiple times. Not all of the steps need be performed however. For example, steps (a) and (b), or steps (b) and (c) may be performed, without the third step.

As shown in FIG. 1, the automatic card shuffling device may have three card-holding compartments: a left-hand compartment 30, a right-hand compartment 20 and a central compartment 10. The compartments are capable of being moved vertically with respect to each other. Generally, the left-hand and right-hand compartments may be maintained so that they are at the same level with respect to a base portion of the device, and the central compartment may be movable in a vertical direction. Although the device may be constructed such that only the central compartment moves vertically, a more compact vertical arrangement may result when more than one of the compartments is capable of vertical motion. The central compartment 10 is sized and dimensioned so as to be capable of accommodating at least one deck of playing cards 90, and the left-hand and the right-hand compartments 30 and 20 are sized and dimensioned so as to be capable of accommodating at least half of the contents of the central compartment 10.

The mechanisms shown in the figures are enclosed in an outer housing or shell (not shown) as would be conventional for a device having moving parts. Apertures for receiving or dispensing cards, connection of electrical power, or the like, would be provided, as will be apparent to a person of ordinary skill in the art. The housing may provide structural support for portions of the mechanism, and mounting provisions for electronics for controlling the operation of the card shuffling device 1. In an aspect, at least a portion of the housing may be substantially transparent so that the operation of the mechanism may be observed, however such construction is not necessary.

One of the compartments, for example, the central compartment 10, or a portion thereof, may be configured so that it is also capable of translation in a direction out of the plane of the drawing, such that it is capable of protruding from the device to accept a deck of cards inserted into the compartment by a person. The central compartment 10 may be moved to accept the deck of cards 90 either mechanically by pulling on a knob, or by an automatic mechanism (not shown) in response to pushing a button, or the like, on the device. Once a deck of cards has been placed into the compartment, the compartment may be returned to an internal configuration. In the state shown in FIG. 1A, the deck of cards 90 is shown as having been placed in the central compartment 10.

Cards are moved by one or more transport mechanisms which will be later described. The deck has N cards, where N is typically 52 as is used in the games of poker, bridge, and the like, but may be any other number such as may be used in preference, pinochle, and the like. Having been placed in the central compartment 10, with the base 100 of the central compartment positioned above an upper lip 32 of the right-hand and left-hand compartments, respectively, cards are dispensed from the bottom of the deck by a transport mechanism (not shown) through a slot or aperture in the bottom of the right-hand-side surface 11 of the central compartment so as to be introduced into the right hand compartment 20. The cards are individually dispensed in this manner such that, as shown in FIG. 1B, approximately half of the cards in the deck placed in the central compartment 10 are transferred into the right-hand compartment 20. The transport mechanism associated with the central compartment 10 now begins to dispense cards from the bottom of the deck through another slot or aperture (not shown) in the bottom of a left-hand portion of the central compartment so that the remainder of the approximately half of the cards remaining in the central compartment 10 are dispensed into the left-hand compartment 30. After completion of this process, in the state shown in FIG. 1C, approximately half of the cards (N/2) are disposed in the left-hand compartment 30 and approximately half of the cards are disposed in the right-hand compartment 20, and there are no cards in the central compartment 10.

The division of the cards of the deck 90 into two portions 90*b*, one in each of the right-hand compartment and the left-hand compartments, need not be exact. That is, only approximately half of the deck of cards may be present in each of the compartments although the total number of cards is the same as the total number of cards N in the deck 90. This is consistent with the human act of cutting, or splitting a deck of cards before or after another of the activities associated with preparing a deck of cards by shuffling. The step of cutting may also be performed again at the conclusion of the shuffling process, although a final cut of the deck may often done manually as a matter of ritual in card games.

When the cutting or splitting operation is performed manually, the number of cards in each resultant stack tends to vary about an even split of the deck. Such a situation may be simulated by programming the controller of the apparatus 1 such that a number of cards in each stack varies randomly about the value of half of the size of the deck, from cut-to-cut.

In another aspect, the split may be performed by dispensing approximately half of the deck 90 from the central compartment 10 into either one of the right-hand compartment 20 or the left-hand compartment 30: a "side compartment". The height position of the central compartment 10 is then lowered with respect to at least the side compartment containing cards. The portion of the card deck that is in the side compartment is dispensed by the side compartment transport mechanism so that the portion of the deck in the one of the side compartments is returned to the central compartment 10. Thus the cards originally on the bottom of the deck in the central compartment have now been returned to the central compartment at the top of the deck.

The riffling process is that of recombining the cards of the portions 90*b* previously dispensed into the left-hand compartment 30 and the right-hand compartment 20 into a single deck of cards 90 positioned in the central compartment 10. The central compartment 10 is positioned such that a base 200 of the right hand compartment 20 and a base 300 of the left hand compartment 30 are disposed in the vertical plane such that each of the right hand base 200 and the left hand base 300 is above an upper lip 12 of the central compartment 10. This repositioning of the compartments may be performed by either lowering the central compartment 10 with respect to the right-hand compartment 20 and the left-hand compartment 30 or, alternatively, raising the right-hand compartment 20 and the left-hand compartment 30 with respect to the central compartment 10. It should be noted that it is the relative position of the compartments that characterizes the process, and which of the compartments are actually moved is a design detail.

In the state shown in FIG. 2A, the riffling process is begun by activating the transport mechanisms of the right-hand compartment 20 and the left hand compartment 30 such that cards are dispensed from the bottom of the partial deck 90*a* in the left-hand compartment 30 and the bottom of the partial deck 90*b* in the right-hand compartment 20 into the central compartment 10 through apertures (not shown) in the bottom of a side 33 and a side 23 of the left-hand compartment 30 and the right-hand compartment 20, respectively.

The transport mechanisms are operated contemporaneously. That is, the transport mechanism of the right-hand compartment 20 and the transport of the left-hand compartment 30 are activated such that cards are being dispensed from each of the right hand compartment and the left hand compartment 30 in an individual fashion and where the dispensing of cards substantially alternates between the slot of the left-hand compartment 30 and the slot of the right-hand compartment 20. In this manner the partial decks of cards 90*b* are recombined into a complete deck 90 disposed in the central compartment 10 as shown in FIG. 2 B. In this state, the cards of the deck are arranged such that, approximately, a card dispensed from the right-had compartment 20 is alternated with a card dispensed from the left-hand compartment 30. While the alternate arrangement of the dispensed cards is a generally desirable result, alternation of two cards from one of the left-hand or right hand compartment with one card from the other of the left-hand or right-hand compartment is not detrimental. Such a lack of perfect alternation may be a result obtained with manual shuffling, and so long as there is not a perceived contrived arrangement of the resultant deck of cards, the operation can be considered successful.

Another manipulation of the cards which may be introduced into the shuffling operation is stripping, which is a variation on cutting, and is shown in FIG. 3. The arrangement of the compartments is the same as for the cutting operation of FIG. 1, and the mechanical details of the arrangement will not therefore be further described. A deck of cards 90 is positioned in the central compartment 10. The transport mechanism of the central compartment 10 is operated so as to dispense a quantity of cards from the central compartment 10 into the right-hand compartment 20. Where the deck has a quantity of cards N, the number of cards dispensed is an integer number, M. After dispensing M cards into the right hand compartment 20, the transport mechanism of the central compartment then dispenses an integer number of cards M into the left hand compartment 30. Typically, the integer number of cards M may be between 2 and 10, but other values are possible. Exactly M cards may not be dispensed at each stage of the operation, and the value of M may change during the operation. This is comparable to the variability of performing this operation by a human. When M is N/2, the stripping operation degenerates into a cutting operation.

With a combination of cutting, riffling and stripping, the typical operations associated with shuffling a deck of cards for the playing of a card game may be performed by the automatic card shuffling device 1. The number of times that each operation is performed, and the sequence of the operations, may be fixed during the design of the apparatus, or an input device may be provided on the apparatus such that a user may customize the process for a particular application, such as games having less than 52 cards in a deck, or a greater or lesser number of the component actions of the shuffling process. For example, a lesser number of operations will take a shorter period of time to perform, but may not as fully randomize the distribution of cards in the shuffled deck.

Figure 4A:
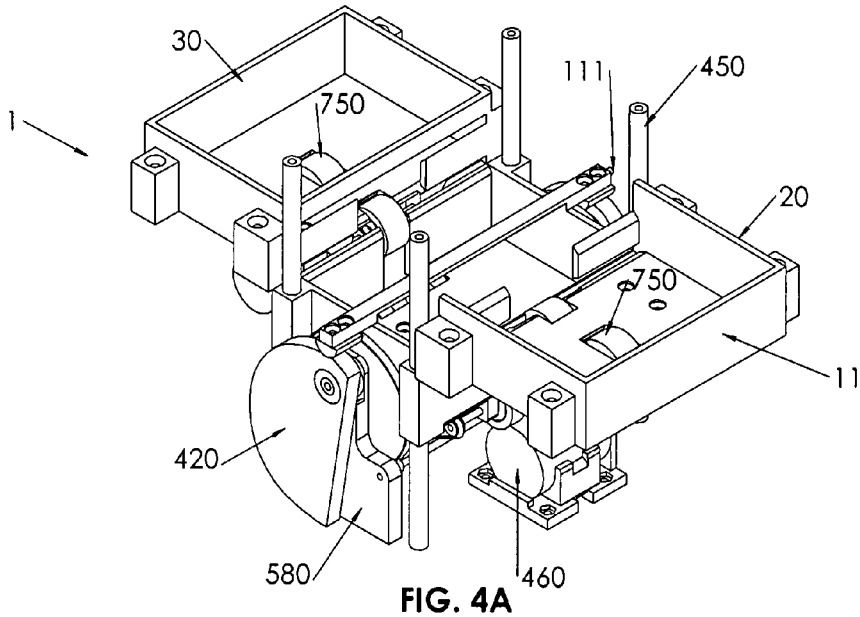
FIG. 4 is a (A) perspective view; and, (B) an exploded perspective view of an example of a card shuffling apparatus.
Figure 4B:
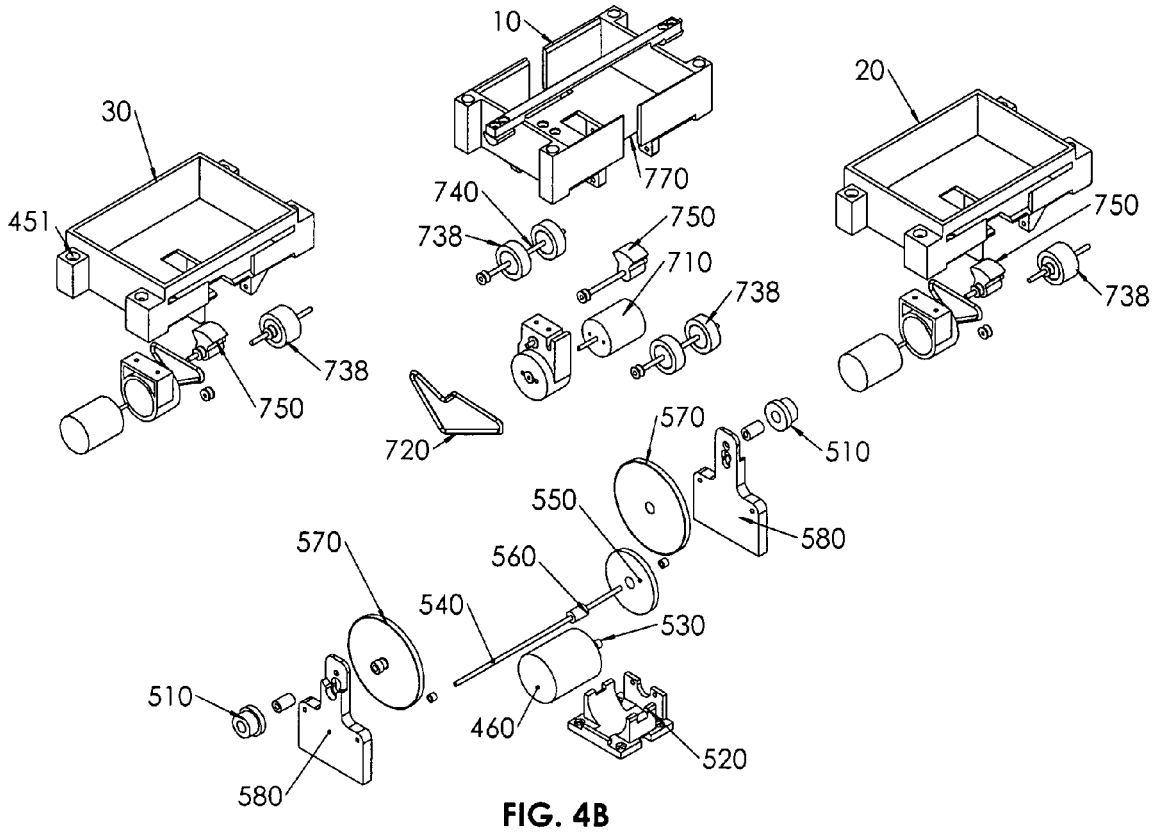

An example of an automatic card shuffling apparatus 1 is shown in FIG. 4. A perspective view of the interior mechanisms is shown in FIG. 4 A and an exploded view is shown in FIG. 4 B. For clarity, such components as electrical wiring, power supplies, computer boards and the like are not shown as these aspects are well known and would unduly complicate the figures. The card shuffling apparatus 1 is intended to be mounted to a support structure, which may include an exterior housing. One of the compartments, which may be the central compartment 10 is adapted to slide in a horizontal plane, in whole or in part, as later described, so as to project horizontally with respect to the state shown in FIG. 4 A so as to facilitate the introduction or removal of the cards to be shuffled. A cam 420 and cam follower 111 act as an elevator or lifting mechanism to move the central compartment 10 up and down with respect to a right-hand compartment 20 and a left-hand compartment 30. In this example, the central compartment 10 is guided in the vertical direction by posts 450 threaded through engaging holes 451 in the corners of the central compartment 10.

Although not shown, a side of the housing of the apparatus may be made partially or wholly of substantially transparent or transparent material so that the operation of the apparatus can be observed by a player. And end surface of the compartments may also be made partially of wholly of substantially transparent or transparent material. Verification of operation of the shuffler may be considered either desirable or necessary by the persons using the device.

Although the description herein may explain the operation by, for example, placing the deck of cards 90 in the center compartment 10, when the center compartment 10 is in a raised position, and removing the cards from the center compartment 10, when the center compartment 10 is in a lowered position, this is only one example of a configuration which may be chosen for the design or operation of the card shuffler device 1. Access to the central compartment may be possible in a particular design in one or both of the raised or lowered positions, or be restricted by the placement of other components.

In an aspect, access may be provided to the card shuffler device 1 by at least one of the side compartments 20, 30 so that the cards may be introduced or removed from the side compartments 20, 30, either directly or using a sliding mechanism. The operational program of the shuffler may be designed to accommodate the specific compartment into which the cards are introduced or removed, for example, such that the cards are first moved by the transport mechanism from a side compartment 20, 30 to the central compartment 10 prior to the start of the shuffling process, and returned to the same or different compartment after the completion of the shuffling process.

Figure 5A:
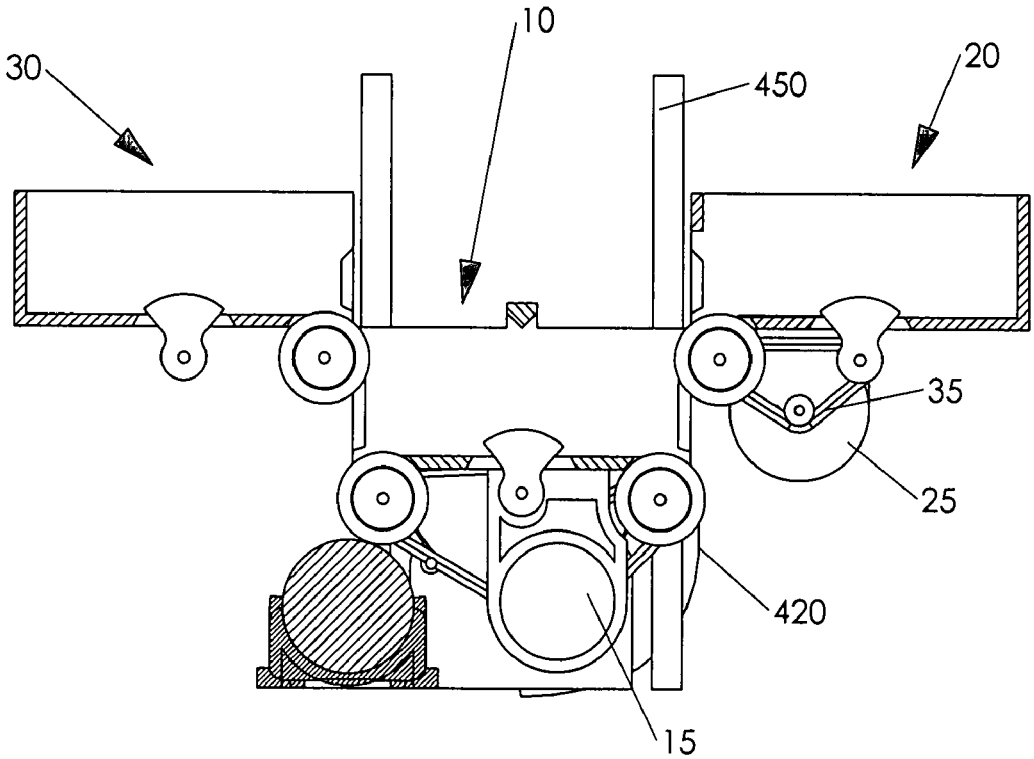
FIG. 5 shows the orientation of card compartments when performing (A) a riffle operation; and, (B) a cut, split, or stripping operation
Figure 5B:
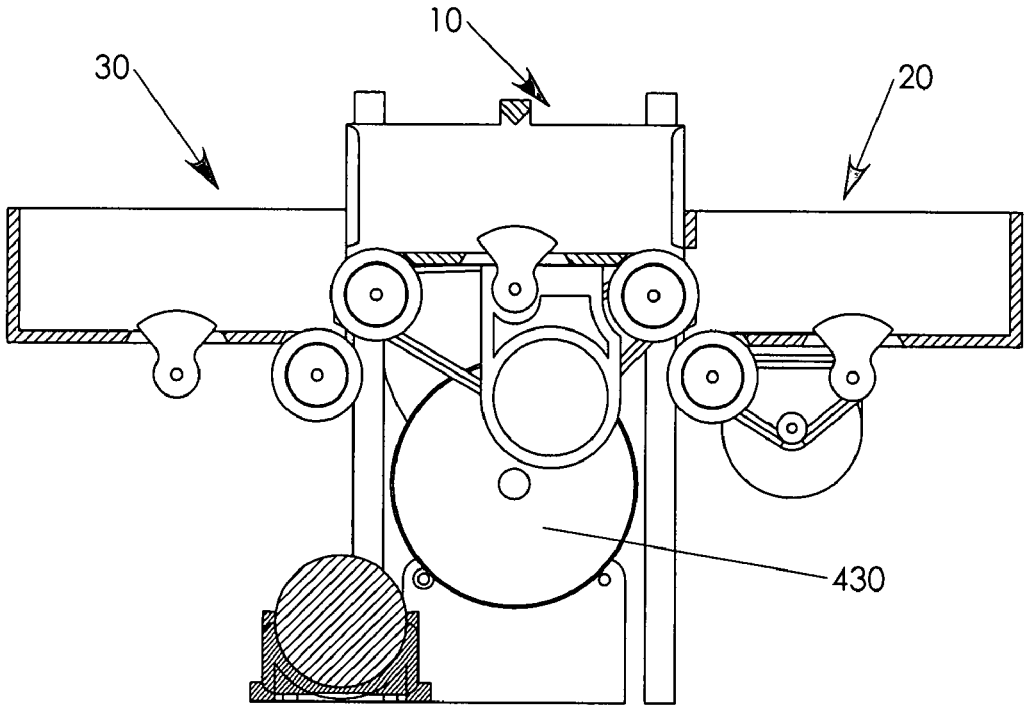
Figure 6A:
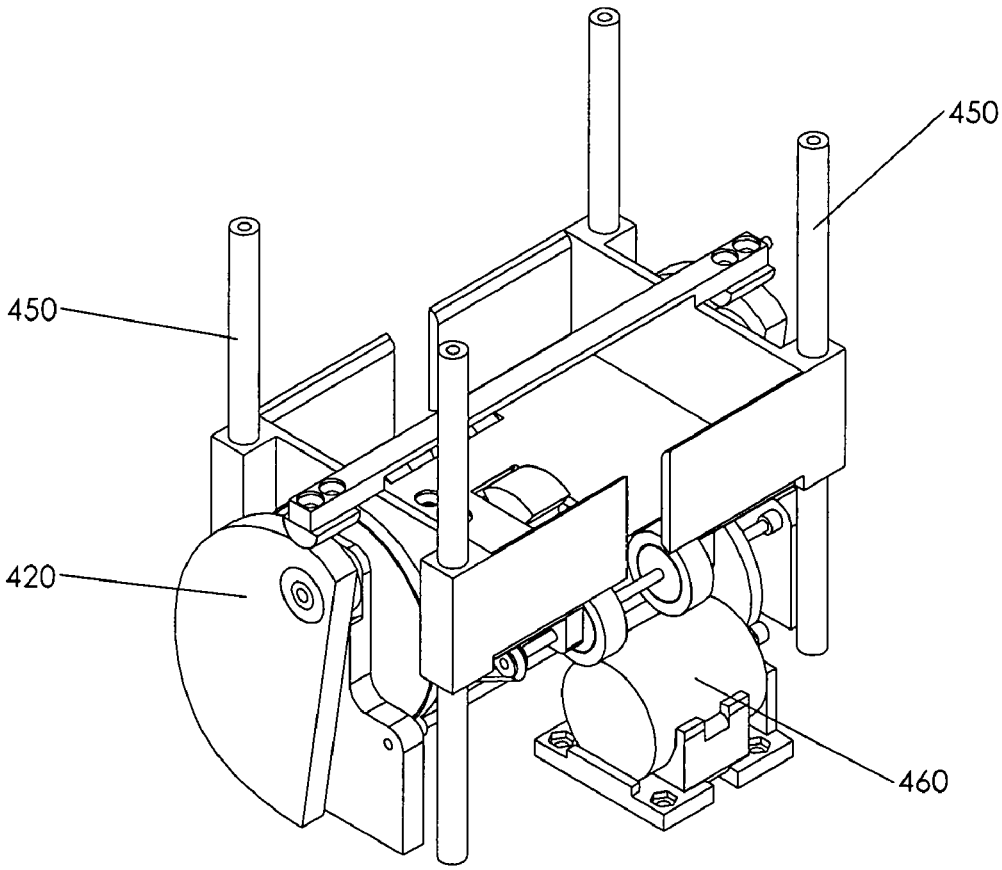
FIG. 6 is a detail view showing the central card compartment and an associated elevator mechanism in (A) a lowered position; and, (B) a raised position.
Figure 6A:
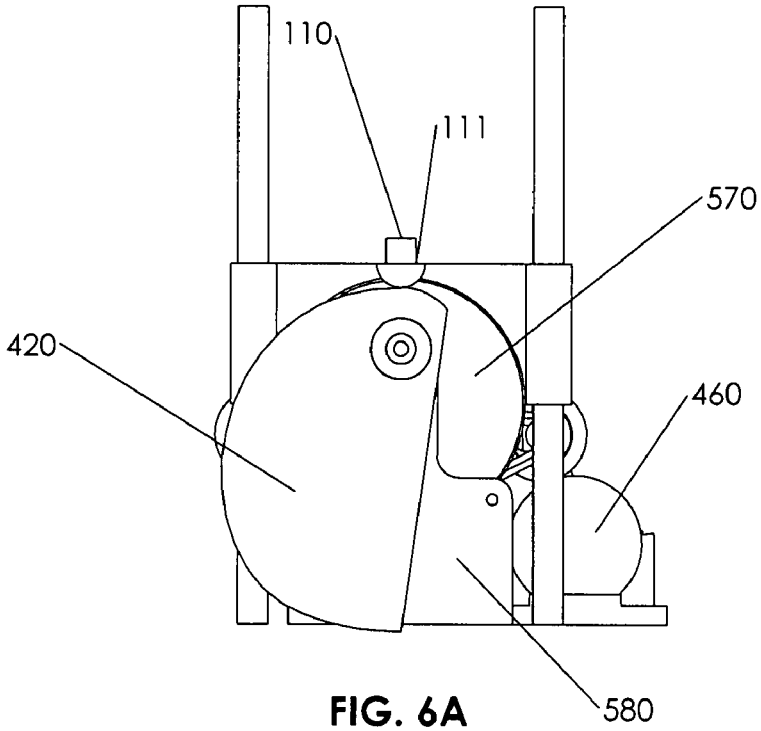
Figure 6B:
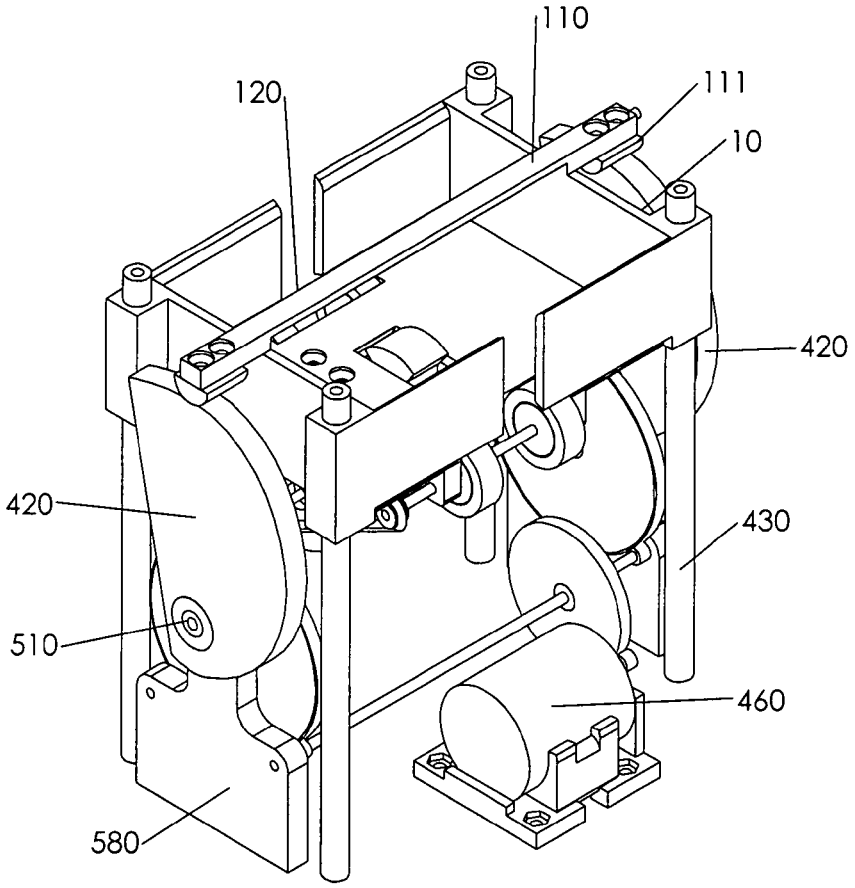
Figure 6B:
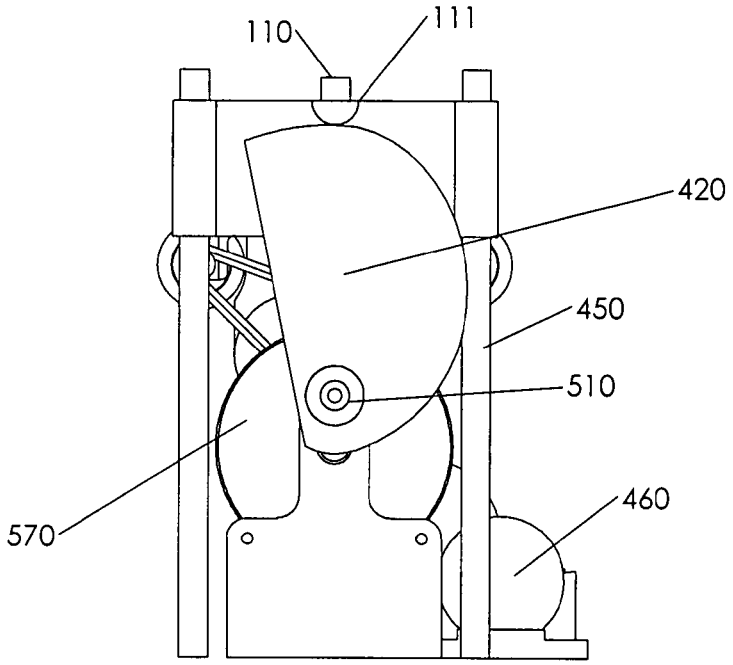

FIG. 5 is an elevation cross-sectional view of the left-hand compartment 30, the right-hand compartment 20, and the center compartment 10. Attached to the bottom of the compartments are the left-hand transport mechanism 35, the right-hand transport mechanism 25 and the central transport mechanism 15. Each of the transport mechanisms may have a motor, an assemblage of pulleys, drive belts and other components. In addition, support posts 450 may be disposed at the four corners of the center compartment 10 such that the center compartment 10 may be slideably supported for motion in the vertical direction.

FIG. 5 A shows a state where the positions of the center compartment 10, the right-hand compartment 20 and the left-hand compartment 30 are arranged such that a riffle operation, as in FIG. 2, may be performed. Each card may be ejected or dispensed from the left-hand compartment 30 and the right-hand compartment 20 into the central compartment through a slot or aperture in a lower portion of the side wall of the left-hand and right-hand compartments.

FIG. 5 B shows a state where the positions of the center compartment 10, the right-hand compartment 20 and the left-hand compartment 30 are arranged such that the cutting or splitting operation of FIG. 1 may be performed. Cards are dispensed or ejected from the central compartment 10 into the right-hand compartment 20 through the slot in a lower end of the side wall of the central compartment. After a number of cards are dispensed from the central compartment 10 to the right-hand compartment 20, the transport mechanism of the central compartment 10 is operated to dispense cards through a slot in a lower side wall of the central compartment 10 into the left-hand compartment 30.

This state shown in FIG. 5 B is the same as shown in FIG. 1 B and may be associated with either a cutting operation or a stripping operation of FIG. 3, depending on the number of cards dispensed in sequence into one of the side compartments before cards are dispensed into the other one of the side compartments.

Although a sequence of actions where the right-hand compartment is mentioned before the left-hand compartment may be used to describe an portion of the process, a person of ordinary skill in the art will appreciate that the terms left-hand and right-hand compartment are used for convenience in description, and the description is intended to encompass an interchange of the sequence of operations of the left-hand and the right-hand compartments, and of the order in which the central compartment dispenses cards into the side compartments.

The central compartment 10 may be raised or lowered with respect to the left-hand compartment 30 and the right-hand compartment 20 by an elevator mechanism, an example of which is shown in FIG. 6. A cam and cam follower mechanism actuated by a rotary motor is shown, however any means of raising and lowering the central compartment 10 may be used, including for example, crank mechanisms, a crank with a connecting rod, and scissors jacks, a rack and pinion or the like. The selection of elevator mechanisms may depend on the interior design of the automatic card shuffling device, the weight of the deck(s) of cards, cost, and other engineering considerations.

In another aspect, the vertical position of the central compartment 10 may remain fixed and one or more of the side compartments may be raised and lowered with respect thereto.

An example of an elevator mechanism is shown in FIG. 6, where a cam and cam follower are used to change the vertical position of the central compartment 10. The central compartment 10 may be guidably restrained by vertical posts 450, by slide grooves (not shown) in the external housing, or the like. In this example, apertures are provided in the four corners of the central compartment 10, and sized to slidably receive the vertical posts 450, so that the central compartment may move in a vertical direction. The central compartment has a deflector bar 110, which may have an extension that functions as a cam follower 111. A cam 420 is fixed to an axle rotatable by a motor 460. The weight of the central compartment 10 may maintain the cam follower 111 in contact with a surface of the cam 420. Maintaining this contact may be assisted by springs (not shown) placed over the vertical posts 450 and bearing on the upper supports of the vertical posts 450, or a similar configuration, so as to exert a downward pressure on the central compartment 10 when the central compartment 10 is in a uppermost position (such as shown in FIG. 6 B). FIG. 6 A shows the central compartment 10 in a lowered position and the cam follower 111 is closer to the axis upon which the cam 420 rotates than the situation which obtains when the central compartment 10 is in the uppermost position (as shown in FIG. 6 B).

The deflector bar 110 may be omitted or, alternatively, also provided in the side compartments. A resilient member may be projected from the deflector bar 110, or other surface of a compartment, or a surface of the enclosure, so as to deflect or guide the cards being introduced into a compartment so that the cards are accumulated in a stack oriented substantially flat with respect to a bottom surface of the compartment.

A second cam 420 and cam follower 111 may be provided on an opposing side of the central compartment 10 so that the forces applied in the lifting process are symmetrically distributed.

Figure 7:
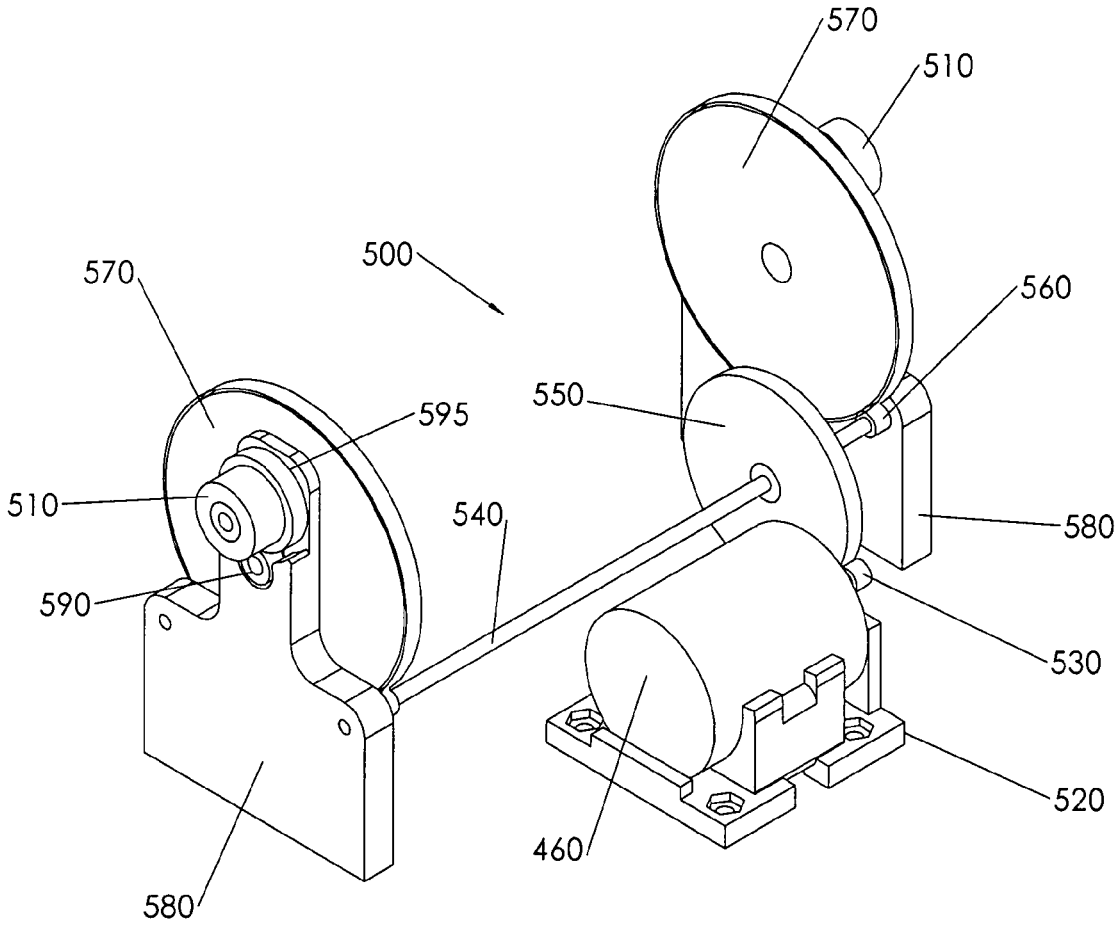
FIG. 7 shows a detail view of part of the drive mechanism for a cam-type elevator mechanism.

As may be seen in FIG. 6 B and in more detail in FIG. 7, the cam 420 is rotatably moved by a gear train 500 coupled to the motor 460. The cam 420 is fixably attached to an end of shaft stub 510, mounted to a bushing (not shown) in an end plate 580 of the elevator mechanism. The shaft stub 510 is rotated by the motor 460, the motor 460 being fixably attached to the assembly body (not shown) by a mounting bracket 520. A motor shaft is terminated by a pinion gear 530, engaging a bull gear 550. The bull gear 550 is fixedly attached to a shaft 540 extending between bushings on opposing end plates 580. Also attached at either end of the shaft 540 are second pinion gears 560, engaging second bull gears 570. The second bull gears 570 are mounted to the end plates 580 by a shaft having a third pinion gear 590 on an opposing side of the end plate 580, so as to rotatably captivate the second bull gear 570 to end plate 580. The third pinion gear 590 engages a geared portion 595 of the shaft stub 510. When the motor 460 rotates, the gear train causes the cam to rotate about the shaft stub 510 as an axis. The cam follower 111, in contact with the cam 420, raises or lowers the central compartment 10, depending on the direction of rotation of the motor 460.

The details of the gear train are a matter of engineering choice depending on the mechanical advantage desired, the overall layout of the assembly, and the like.

Figure 8A:
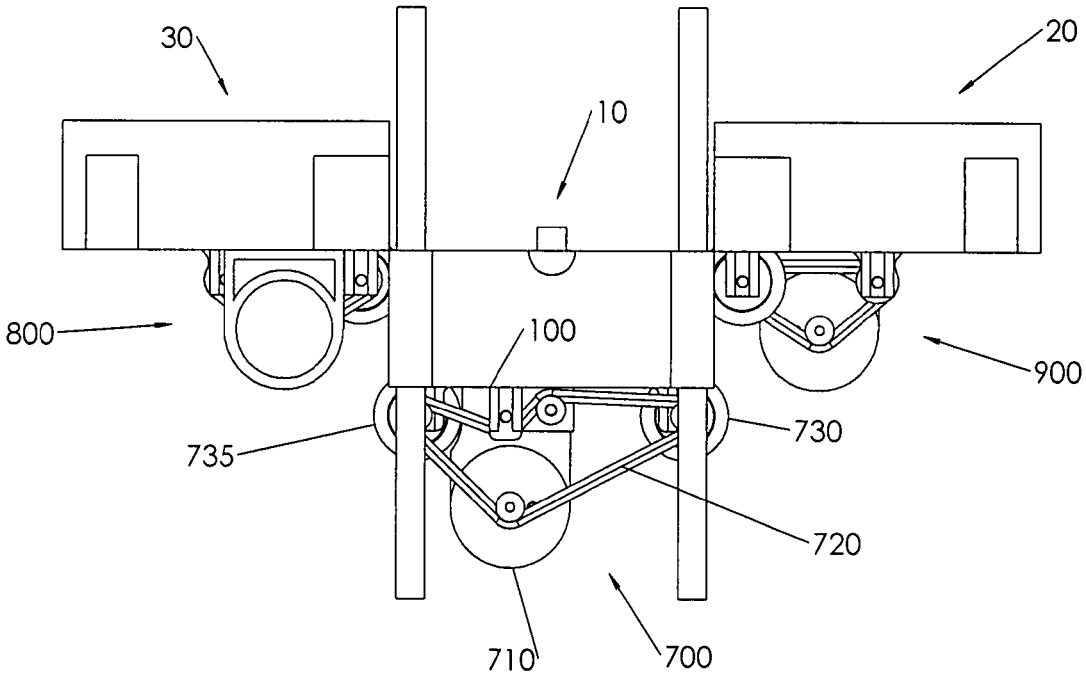
FIG. 8 shows a detail view of the card transport mechanisms: (A) the left-hand, right-hand and central compartments disposed for riffling, and (B) the central compartment in a perspective view.
Figure 8B:
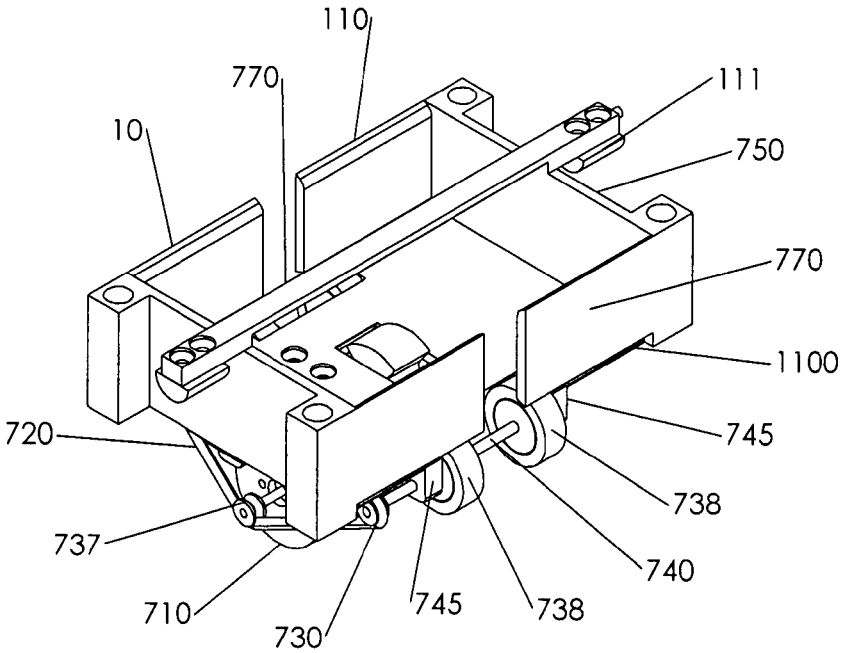

As shown in FIG. 8, a left-hand compartment transport mechanism 800, a central compartment transport mechanism 700 and a right-hand compartment transport mechanism 900 may be provided for dispensing cards from each of the compartments to another of the compartments. The central compartment transport mechanism 700 may be configured so as to be capable of dispensing cards into the left-hand compartment 30 or the right-hand compartment 20. The left-hand compartment transport mechanism 800 is capable of dispensing cards from the left-hand compartment 30 to the central compartment 10, and the right-hand compartment transport mechanism 900 is capable of dispensing cards from the right-hand compartment 20 to the central compartment 10.

As shown in FIG. 8, the central compartment transport mechanism 700 is mounted beneath the lower surface 100 of the central compartment. A motor 710 is mounted to the underside of the lower surface 100 and drives a belt 720 engaging with fixed pulleys 730 and 735 disposed near opposing sides of the central compartment 10 and pulley 737 on the motor shaft. Right-hand pulley 730 is mounted at an end of shaft 740 which is supported with respect to the lower surface 100 by mountings 745, having a bushing. Two rollers 738 are attached to the shaft 740 such that they rotate with the shaft 740. The rollers 738 are sized such that they project through the lower surface 100. An opening 772 is provided in the lower surface 100 so that the rollers 738 may contact the bottom card of the deck of cards, or portion thereof that may be in the central compartment 10. Another pulley and roller 750 are disposed in an opening in the central region of the lower surface 100.

When the motor 710 is actuated and rotates in a clockwise direction as viewed from the front in FIG. 8, pulley 730 also rotates in a clockwise direction and similarly drives the rollers 738. The pulley driving the central roller 750 is arranged such that the central roller 750 also rotates in a clockwise direction. The lowermost card of a deck of cards, resting on the central roller 750 and the right-hand rollers 738 will be urged towards the right-hand compartment 20 through a slot 1100 in the lower right-hand side of the central compartment 10. Rollers are also present on the left-hand side of the central compartment 10 and may rotate in the same direction as the rollers previously described. The left-hand rollers may contribute to the initial urging force for transporting the card from the central compartment 10 to the right-hand compartment 20.

When the motor 710 is actuated and rotates in a counterclockwise direction, the direction of rotation of the rollers 738 and 750 is reversed, and the lowermost card of the deck of cards will be urged towards the left-hand compartment 30 through a slot in the lower left-hand side of the central compartment 10. Thus, by controlling the direction of rotation of the motor 710, the cards may be dispensed or ejected into one or the other of the side compartments. The number of cards dispensed may be determined by the time duration of operation of the motor, the number of revolutions of the rollers, or by a sensor determining the number of cards dispensed through a slot or received by a compartment. The exhaustion of the stack of cards in a compartment may also be used to sense completion of a portion of the process.

The completion of this aspect of the process may be determined by any one or more of: time duration of the dispensing operation; the number of rotations of a roller; a sensor in the compartment from which the cards are ejected; a sensor in the compartment receiving the cards, or the like. Whenever a card transfer operation is described, the means of determining completion of a step or a portion of a step being described may be determined by one or more of the sensing or timing operations. The sensing operation may be by any one of optical or mechanical means such as a photodetector, feeler gauge or the like, and the control of the device actions may be by means of a mechanical linkage, or a microprocessor having a memory and executing stored computer readable instructions.

The rollers 750, 738 may be smooth, roughened, or have sticky properties. In addition, the roller 750, which may be termed a "kicker" may have a surface where a segment of the circumference is recessed with respect to a maximum diameter of the roller. In this aspect, the roller 750 may contact the card for only a portion of the rotation of the roller. The kicker may operate to lift the deck of cards so that a plane of the lower card is angled towards the slot or aperture. When the roller 750 is extended to approximately a maximum height above the bottom surface of the compartment, the lower card may be positioned with respect to the aperture so as facilitate the passage of the card through the aperture. This may result in approximately a maximum projection of a portion the aperture orthogonal to the plane of the card being dispensed or ejected through the aperture. When used in this manner, the roller may assist in maintaining a flow of individually dispensed cards. The aperture may be sized and dimensioned so that a card lying approximately flat with respect to the bottom of the compartment may not pass through the aperture.

Each of the side compartments has a similar transport mechanism to that of the central compartment 10. The side compartment transport mechanisms 800, 900 may have a central roller 750 and rollers 738 disposed at the side of the compartment adjacent to the slot leading into the central compartment through the lower side wall of the side compartment. As cards in either of the side compartment are dispensed into the central compartment 10 from either the left-hand compartment 30 or the right-hand compartment 20, the motor associated with the transport mechanism is rotated either clockwise or counterclockwise as appropriate.

Figure 9A:
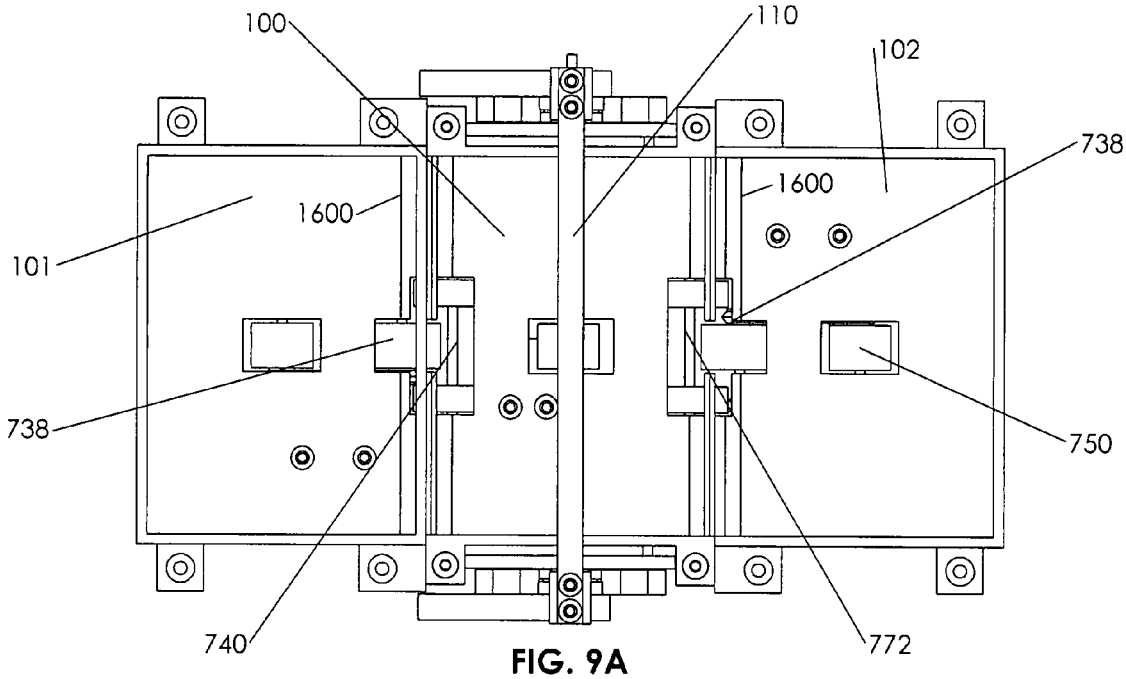
FIG. 9 shows (A) a top view of FIG. 8A; and, (B) a side view of FIG. 8A including the cam-type elevator.
Figure 9B:
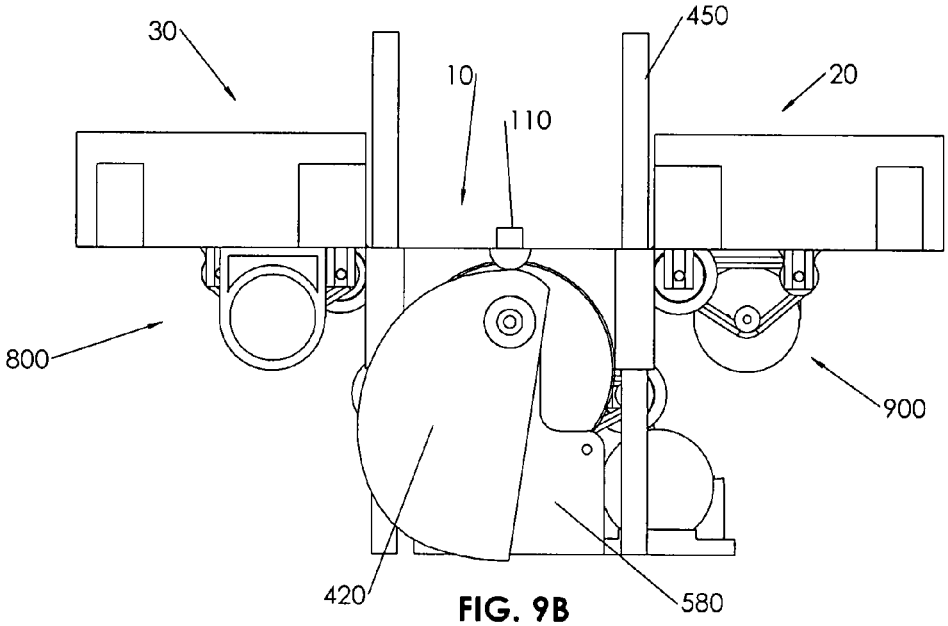

The side compartment rollers 738 are illustrated in FIG. 9 A, where it may be seen that adjacent rollers 738 may be provided in each side compartment, protruding through a slot 740 in the lower surfaces 101 and 102 of the side compartments. The spacing between the rollers in the side compartments is such that the rollers are disposed between the rollers 738 at either side of the central compartment 10. This is one of many configurations of rollers which may be used. The side compartment rollers 738 may be combined into a single roller, or the arrangement of the side compartment rollers and the central compartment rollers interchanged. A slotted opening 770 may be provided in the side walls of the central compartment 10 so as to provide clearance for the rollers 738 of the side compartments when the central compartment is raised or lowered with respect to the side compartments by the elevator mechanism.

A continuous belt 720 has been shown, but other belt arrangements such as a toothed belt engaging with toothed pulleys or a gear train may also be used. More than one motor may be used to actuate a transport mechanism, and the various pulleys may be sized such that the rotation rate of the rollers may differ.

The weight of a card or cards in the compartment may be sufficient to provide a contact force between the card and the roller 738 or the kicker roller 750 so that the card may be transported in the desired direction in response to the rotation of the motor.

In operation, the central compartment 10 containing a deck of cards 90 and associated transport mechanism 700 may raised by the elevator mechanism so that the dispensing slots 1100 in the central compartment 10 are positioned opposing a top opening in each of the left-hand 20 and the right-hand 30 compartments. The transport mechanism 700 may be operated with the motor turning in a clockwise direction so as to eject cards through the dispensing slot 1100 towards the top opening in the right-hand compartment 20. When a desired quantity of cards has been dispensed in this manner, the rotation sense of the motor may be changed to a counterclockwise direction so that cards may be dispensed through the dispensing slot 1100 from the central compartment 10 into the top opening of the left-hand compartment 30. This dispensing operation is continued until a desired number of cards had been ejected. When stripping cards, these operations may be repetitively performed multiple times. When cutting or splitting a deck, approximately half of the cards are dispensed in the first step and the remainder of the cards are dispensed in the second step. The second step may be run for a time longer than the time duration of the first step, if the step is a timed step, so as to ensure the exhaustion of cards from the central compartment 10.

Once the deck of cards 90 has been cut or stripped, the central compartment 10 is positioned such that the open top of the central compartment 10 permits cards ejected through the dispensing slot 1600 of the left-hand compartment 30 and the right-hand compartment 20 to be merged into a single deck of cards 90 using the riffling process previously described.

The riffling operation is performed by positioning the central compartment 10 so that a top open portion thereof is disposed approximately opposite a dispensing slot 1600 in each of the side compartments (FIG. 9). The card transport mechanisms 800, 900 in the left-hand compartment 20 and the right-hand compartment 30 may be actuated such that both of the card transport mechanisms are active for a substantially simultaneous or simultaneous period of time. The card transport mechanisms eject or dispense cards through the slot 1600 of each of the left-hand compartment 30 and the right-hand compartment 20 into the open top of the central compartment 10. The ejected cards may contact the card deflector 110 so as to be guided into the central compartment 10, although this may not be necessary. The dispensing slot 1600 is dimensioned such that, typically, a single card is dispensed for each full rotation of the shaft to which the kicker roller 750 is attached. The result of this process is a merging of card portions 90*a* and 90*b* into a single stack of cards 90 (not shown) in the central compartment 10 by approximately interleaving individual cards from each of the card portions 90*a* and 90*b*.

The operation of shuffling, including riffling, cutting, and perhaps stripping, may be repeated for a predetermined number of times, typically a total of 6 or 7. The total number of times that the operation is repeated is believed to have an optimum number of 7; however this may be adjusted in accordance with user preferences or requirements, and may be either more or less than 7. A counter display (not shown) may indicate the total number of times the deck of cards 90 has been shuffled.

When the deck of cards 90 has been shuffled for the predetermined number of times, the shuffling operation is considered to have been completed. At the conclusion of the shuffling operation, a compartment may be positioned so that the cards can be removed by a user. This may be accomplished by positioning the central compartment 10 so that an end side thereof is opposite an aperture in the side of the apparatus and a portion of the central compartment 10 may be translated so that it projects from the apparatus 1. Alternatively, the central compartment may be further raised so that the central compartment 10 projects above a top surface of the apparatus 1. The latter arrangement may be useful for flush mounting of the apparatus with a table top. In an aspect, a side compartment may be positioned so that it protrudes from the apparatus or the housing in a state where a deck of cards is being placed in or removed from the apparatus.

The device may automatically translate the central compartment 10 out from the side of the apparatus 1 so that the cards may be removed or may remain in the end of operations state until the user takes some action, such as pushing a control button, to cause the drawer to extend from the device or by mechanically pulling the drawer out. Once the deck of cards 90 has been removed from the compartment, the apparatus 1 is ready to accept another deck of cards.

Each of the compartments has at least one slot 1100, 1600, for dispensing cards, and may have an aperture for receiving cards. FIG. 10 is a cross sectional view showing an example where an aperture for dispensing cards 100 is provided in a side 11 of the central compartment 10. The aperture for receiving cards is the open top of the central compartment 10, having a deflector bar 110. In another aspect, the top of the central compartment may be closed, and a receiving slot disposed in the upper side portion thereof, which may be disposed opposite a dispensing slot in at bottom side surface of a side compartment.

Figure 10A:
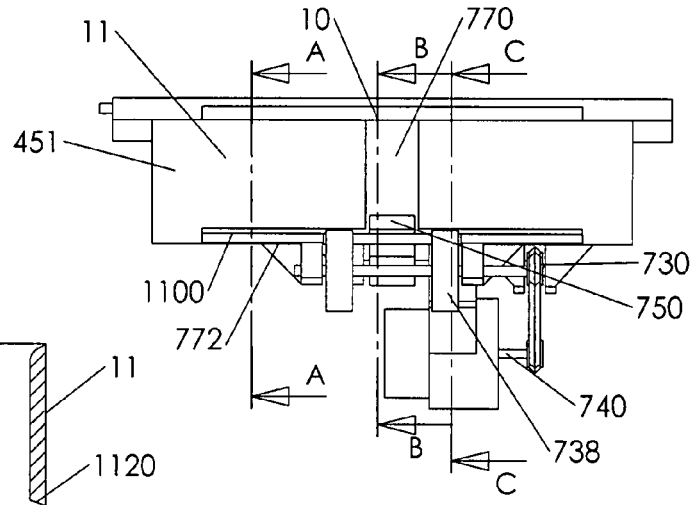
FIG. 10 shows cross sectional views of the central compartment: (A) longitudinal view; (B) a transverse view at the kicker portion of the transport mechanism; (C) a transverse view at a section without transport mechanism components; and, (D) a transverse view at a side-roller-portion of the transport mechanism.
Figure 10B:
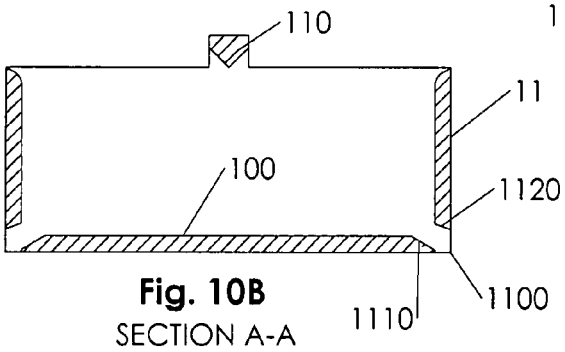
Figure 10C:
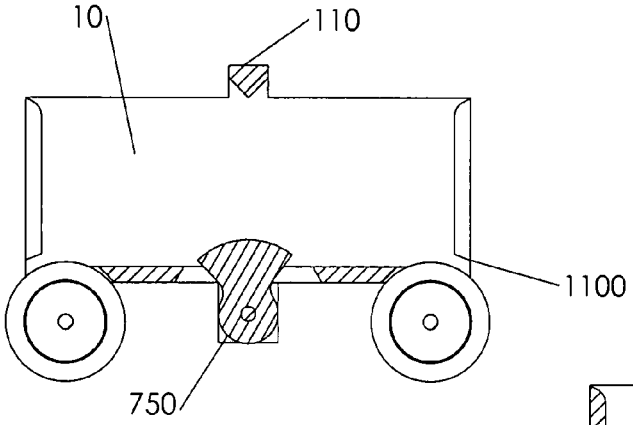
Figure 10D:
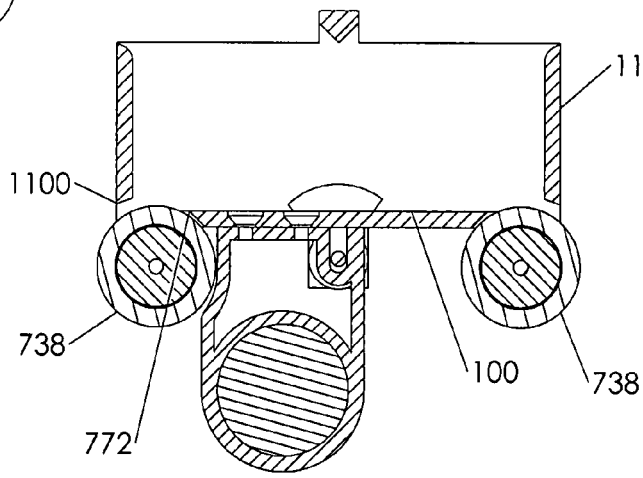

FIG. 10A is an elevation view of a side of the central compartment 10 as viewed from one of the side compartments. A slot 770 is provided in the side 11 extending from the bottom surface 100 to the top of the side 11 so as to provide a clearance for the rollers 738 (not shown) on the side compartments. Rollers 738 of the central compartment are disposed so as to extend through slot 772 into the central compartment 10. The rollers 738 are mounted on shaft 740 so as to have a common shaft with pulley 730. Roller 750 is disposed substantially at the midpoint between opposing side walls 11 of the central compartment 10. Holes 451 are provided in the corner portions of the central compartment 10 so as to engage with vertical supports 450 (not shown). A slot 1100 is disposed near the bottom of the side walls 11, and extends part of the distance between the end walls of the central compartment 10, the length of the slot 1100 being sufficient to accommodate the length of a playing card. A minimum cross section of the slot 1100 is at least greater than the thickness of a playing card, and may be shaped to facilitate the dispensing of a playing card through the slot 1100. The slot may be angled so that the card may have to be lifted by the kicker in order to pass through the minimum cross-section region. The slot 1600 in the side compartments has similar characteristics to the slot 1100 in the central compartment 10.

FIGS. 10 B-D illustrate simplified cross-sectional views of the central compartment 10. FIG. 10B is a cross section view at B-B through the central kicker roller 750. The cross-section of the kicker roller 750 is such that the diameter of a portion of the circumference thereof is less than a maximum diameter thereof. The maximum diameter thereof is sufficient to bring a circumferential surface of the kicker roller 750 in contact with a card laying on the lower surface 100, however the smaller diameter is such that there is no contact between the kicker roller 750 and the card. Therefore, the kicker roller 750 may be in contact with the card for only part of the rotation period of the kicker roller.

FIG. 10 C illustrates cross-section A-A where the slot 1100 is at the base of the side wall 11 and may have an aperture formed between a upper surface 1120 associated with the side wall 11 and a lower surface 1110, associated with the lower surface 100 of the central compartment 10. The upper 1110 and lower surfaces 1120 of the slot 1100 may be inclined so as to guide the card in a downwards direction as the card is dispensed through the slot 1100, and to have a dimension between the upper surface 1110 and the lower surface 1120 that is greater than a single card thickness, while having a dimension that tends to result in cards being dispensed substantially one at a time. The slot may be angled downward, and may be sized and dimensioned so that a single card passes through the aperture when the card is urged from an angled position by the kicker. Thus, only a single card may be dispensed for each revolution of the kicker. The edges of the surfaces 1110 and 1120 may be rounded at the entrance or exit of the slot 1100.

FIG. 10 D illustrates cross-section C-C through one of the rollers 738 and shows the opening 772 permitting the roller 738 to project through the bottom 100 of the central compartment 10 so as to be capable of contacting a card laying on the upper surface of the bottom portion 100.

The side compartments are similar in construction to that of the center compartment, however a roller may not be provided on the side of the side compartment distal from the central compartment 10, and the equivalent of a slot 770 may be provided should a clearance aperture be needed between the rollers 738 of the side compartment and a side 11 of the central compartment 10. The side compartments may be sized so as to receive half of the deck 90 as the cutting, splitting or stripping processes transfer only half of the cards in the deck from the central compartment to any one of the side compartments, providing that the side compartment so sized is not one through which a full deck of cards is introduced to, or removed from, the apparatus.

A variety of elevator mechanisms are known to those of skill in the art, and would be selected depending on the size of the overall apparatus and the placement of other components within the apparatus, the weight to be moved, or other engineering considerations.

Figure 11A:
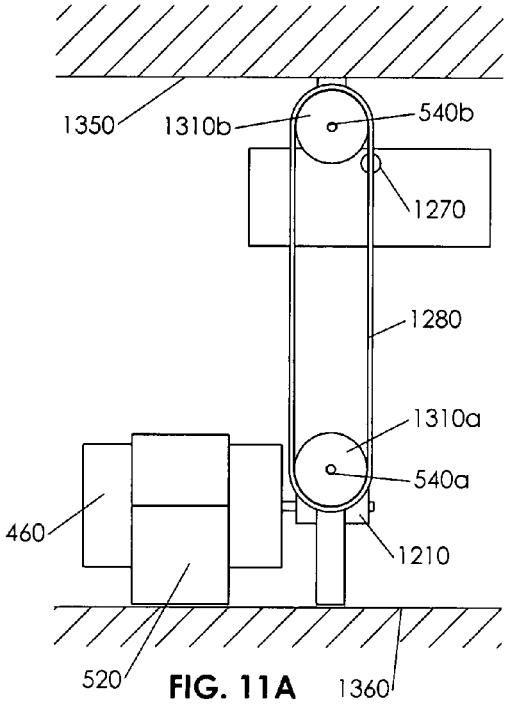
FIG. 11 is (A) an end view; (B) a side elevation view; and (C) a perspective view of a belt driven elevator mechanism.
Figure 11B:
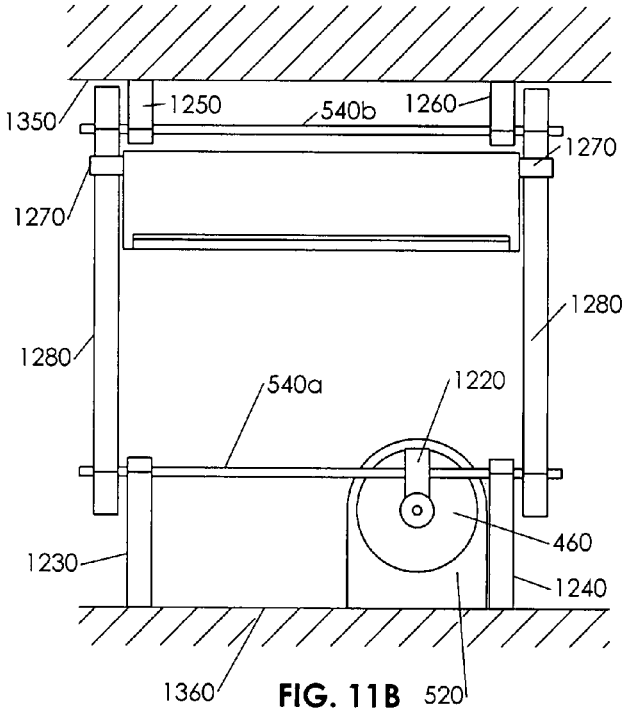
Figure 11C:
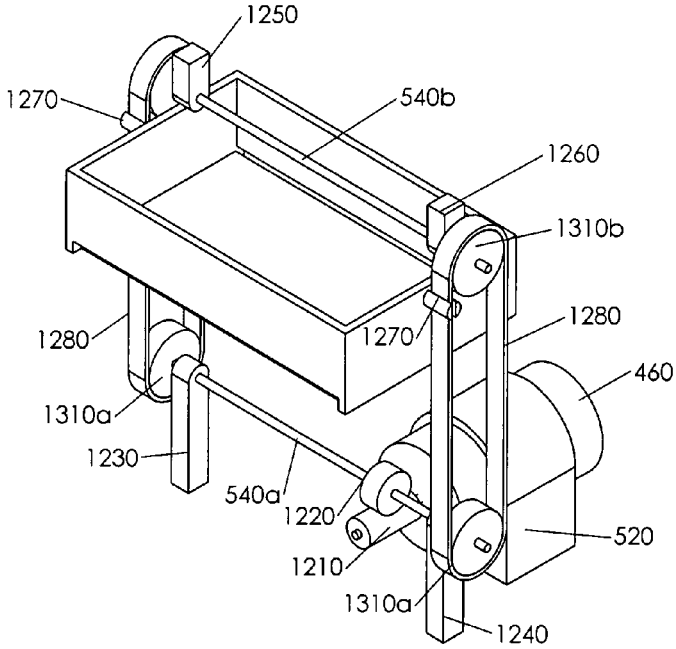

In an aspect, the elevator mechanism may be as shown in FIG. 11 A-C. Here, the sliding support posts 450 and the captivation holes 451 are not shown, for clarity. The symmetrical belt drive mechanism of this example has fewer gears and components than that shown in, for example FIG. 4, but serves an equivalent purpose. Only the central compartment 10 of the three card compartments is shown. A supporting structure is shown conceptually by surfaces 1350 and 1360, which may represent the housing of the card shuffler apparatus 1, or other fixed support so that the support posts 1230, 1250, 1260, 1270 are maintained in a fixed relationship to each other.

A motor 460 is mounted to the lower support surface 1360 by a mounting 520 and has a worm 1210 extending from one end thereof. The worm 1210 engages a worm gear 1220 that is fixedly attached to a lower axel 540*a*. In this manner the rotational motion of the motor is transferred to a rotational motion of the lower axel 540. The selection of the gearing of the worm 1210 and worm gear 1220 is selected, for example, based on torque and speed requirements. The axel 540*a* passes through bushings in lower supports 1230 and 1240 so as to permit a pulley 1310*a* to be fixedly attached thereto at one or both ends. Alternatively, the pulley may be affixed to the axel prior to the shaft engaging the bushing.

Where the term "fixedly" attached or joined is used, the components being thus described are attached, affixed or joined together in a temporary or permanent manner so that they maintain a fixed relationship to each other in an operational state. Any known fastening technique may be used, depending on manufacturing or servicing considerations, to include gluing, heat sealing, screwing, the use of springs or interlocking portions, riveting, swaging, and the like. Motion in one or more axes other than the axes described as fixed may be permitted during operation An upper axel 540*b* is disposed so as to pass through bushings in upper supports 1250 and 1260, the supports being fixedly attached to an upper support surface 1350. Pulleys 1310*b* may be fixedly mounted to ends of the axel 540*b* protruding from the bushings in the upper supports 1250 and 1260. A continuous belt 1280 is positioned so as to engage with lower pulleys 1310*a* and upper pulleys 1310*b*, such that a rotation of the lower pulleys 1310*a* results in a rotation of the upper pulleys 1310*b* and the upper axle 540*b*.

The central compartment 10 has a engaging fitting 1270, disposed so as to fixedly engage with a belt 1280, and as the belt 1280 moves in accordance with the rotation of the lower pulley 1310*a*, the central compartment 10 is moved up or down in depending on the sense of rotation of the lower pulley 1310*a*.

In an aspect, the belt 1280 may be a toothed belt, with the teeth engaging with corresponding gear teeth on the pulley 1310*a*. Pulley 1310*b* may have teeth, or may be smooth, and the pulleys may have lips (not shown) at the periphery thereof to prevent the belt from sliding off. The pulleys may be fabricated with a sticky surface for contacting the belt in place of the teeth, or the contact between the belt and the pulleys maintained by frictional forces.

Figure 12A:
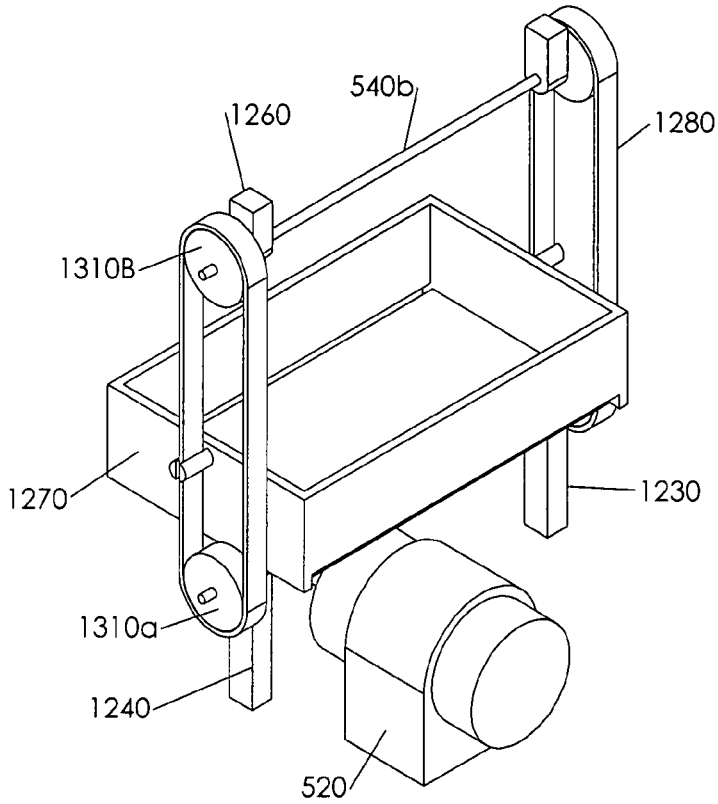
FIG. 12 is (A) a lowered position and (B) is a raised position of the central compartment in a perspective view of a belt driven elevator mechanism.
Figure 12B:
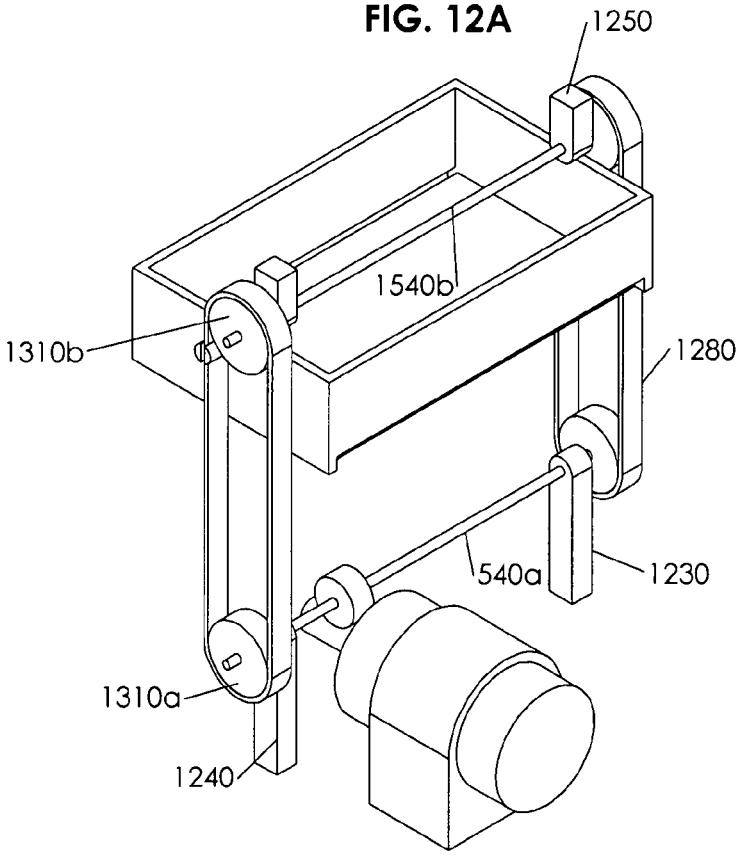

FIG. 11 illustrates the mechanism with the central compartment 10 in a raised position, and FIG. 12 A-B is a perspective view showing the central compartment 10 in a lowered (A) and a raised (B) position.

Figure 13:
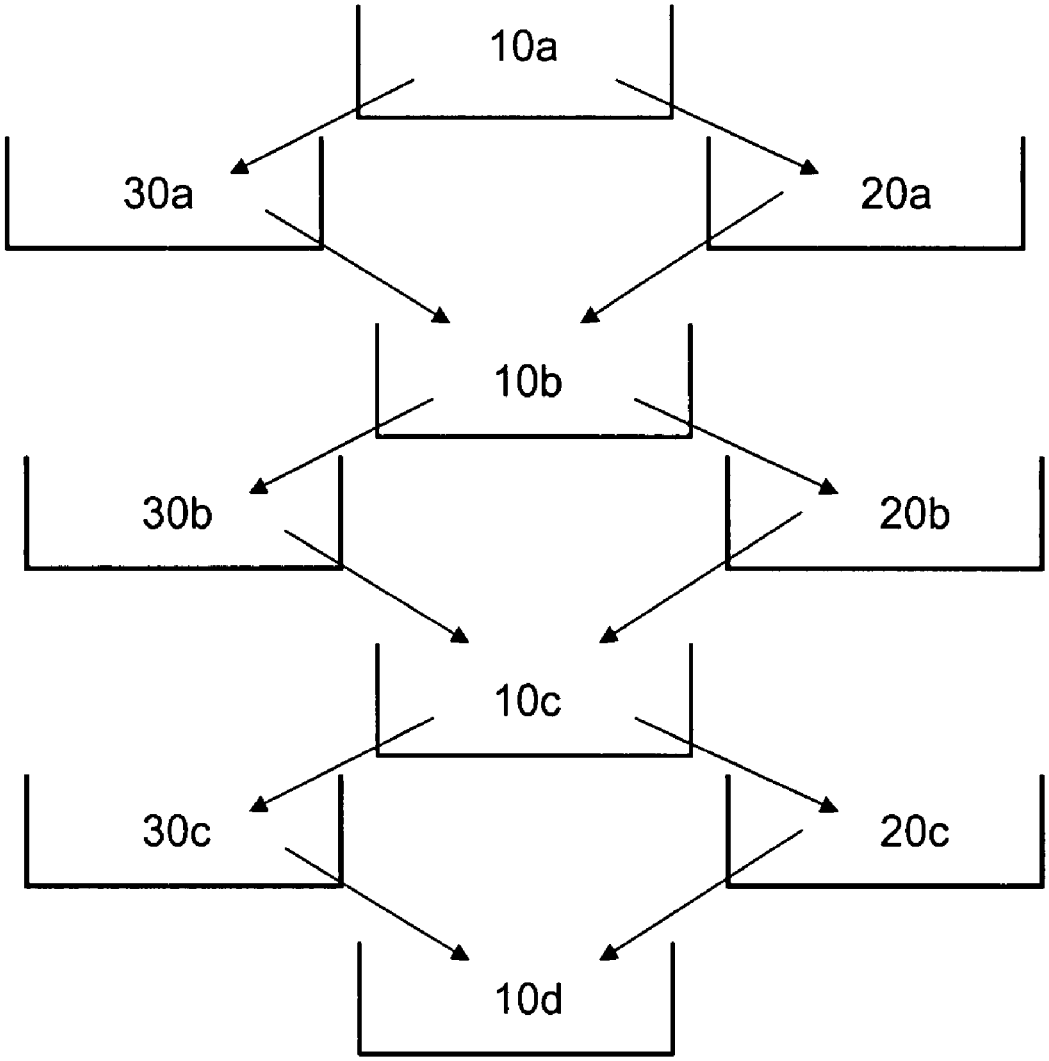
FIG. 13 is a conceptual view of another example where the compartments have a fixed physical relationship.

In another example, the automatic card shuffler apparatus may be configured without an elevator mechanism. FIG. 13 shows a schematic representation of such an apparatus. The same types of card transport mechanisms may be used as described for the first example and the transport mechanisms will not be further described. Similarly the card dispensing slots and other features may be similar, except that there is no elevator mechanism, and clearance slots such as 770 in the previous example may not be needed.

A plurality of center compartments 10 are arranged such that they are vertically interleaved with side compartments 20, 30. Each of the center compartments 10*a*-10*d*, except for the lowermost compartment 10*d* have a card transport mechanism similar to the card transport mechanism 700 of the first example. The topmost center compartment 10*a* receives a deck of cards 90 and the card transport mechanism 700 of the center compartment 10*a* is operated to dispense the cards into side compartments 20*a* and 30*a*. Next, the card transport mechanisms 900 and 800 of the side compartments 20*a* and 30*a* are operated to riffle the cards into the next lower central compartment 10*b*. Once this is completed, the card transport mechanism of compartment 10*b* is operated to dispense cards into side compartments 20*b* and 30*b*, in either a cut or riffle operation. Subsequently, the card transport mechanisms 900 and 800 of the side compartments 20*b* and 30*b* are operated to riffle the cards into the central compartment 10*c*. The cards in central compartment 10*c* are transferred to side compartments 20*c* and 30*c* and subsequently recombined into a full deck in the central compartment 10*d*, which may also act to dispense the card deck 90 to the user. The device may have more or fewer compartments in the vertical stack of compartments depending on the sophistication of the shuffle desired and the manufacturing cost.

The arrangement of this example may result in a taller physical structure than that of the first example, but the arrangement may shuffle the cards somewhat faster than the first example, as it may not have the step of displacing the side and central compartments vertically relative to each other. Should more riffling steps be desired, the cards may be manually transferred from the bottom compartment to the top compartment and the shuffling process repeated.

In another aspect, the operation of the various transport mechanisms may be scheduled contemporaneously so as to further reduce the time to complete a shuffle and the height of the apparatus. For example, after the cards begin to be transferred from the first center compartment 10*a* into the first side compartments 20*a* and 30*a* by the transport mechanism 700 of the central compartment 10, and some cards have accumulated in the first side compartments 20*a* and 30*a*, the transport mechanisms 800 and 900 thereof may be actuated to begin to move the cards from the first side compartments 20*a* and 30*a* into the second central compartment 10*b*. After some cards have accumulated in the second central compartment 10*b*, the transport mechanism 700 associated with the second central compartment 10*b* may be actuated such that the cards begin to be transferred from the second central compartment 10*b* into the second side compartments 20*b* and 30*b*. The operation of the transport mechanism 700 may be such that the motor operates in a clockwise direction for a period of time such as associated with a stripping operation and then rotates in a counterclockwise direction so that groups of cards are alternately deposited in the side compartments. This operation may be continued until the cards are finally deposited in the lowermost central compartment 10*d*. This may significantly shorten the overall time to shuffle a deck of cards by subsuming some of the cutting, stripping, and riffling steps. The height of the central compartments 10*b* and 10*c*, and the side compartments 20*a*-20*c* and 30*a*-30*c* may also be reduced as the compartments may not contain more than a portion of the card deck 90 at any one time.

This procedure may be more analogous to performing a stripping operation; however, at lest one of the operations may be configured to perform a cut or spilt. For performing a split, the side compartment is sized to hold at least half of the deck, whereas the stripping side compartments may be smaller as cards are being ejected from the side compartment to the central compartment during at least part of the filling process.

The operation of the transport mechanisms 800 and 900 may be such that, alternately, the left-hand compartment and the right-hand compartment is the first compartment to begin to return cards the central compartment, and the choice of the left-hand or right-hand compartment to begin this process may be such that the side compartment being filled last is the first to begin to empty the cards into the next central compartment. Other sequences of operation are also possible.

Motors and pulleys may be disposed to the side of the compartments or at the ends thereof in order to accommodate the smaller height of the compartments and a motor may be used to operate more than one transport mechanism.

Figure 14:
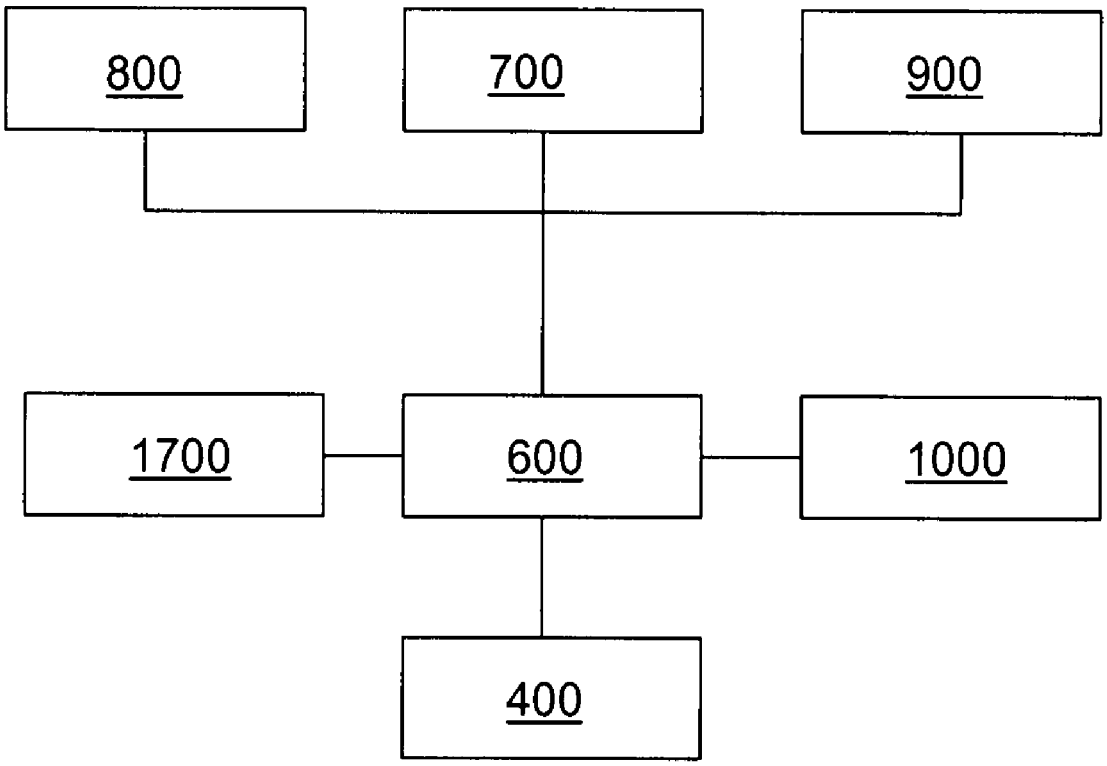
FIG. 14 is a block diagram of the first example showing control functions.

FIG. 14 is a block diagram of the card shuffling apparatus 1 showing the various functions which may be controlled by a computational component such as a microprocessor executing a stored program or machine readable instructions. The instructions for implementing processes of the apparatus may be provided on computer-readable storage media or memories which may have permanent and non-permanent storage capability, such as a cache, buffer, RAM, flash, removable media, hard drive or other computer readable storage media, which now exist or may later be developed. The functions, acts or tasks illustrated in the figures or described herein may executed in response to one or more sets of instructions stored in or on computer readable storage media. The functions, acts or tasks are independent of the particular type of instruction set, storage media, processor or processing strategy and may be performed by software, hardware, integrated circuits, firmware, micro code and the like, operating alone or in combination.

FIG. 14 illustrates an example of a control and operation of the device 1 by use of a microprocessor 600. A control panel 1000, which may be a button or buttons or other input device to initiate a process and provide input to the microprocessor 600 as to the desired operations, and a display 1700 may indicate progress or status. A display may not be provided as the state of the process may be observed visually, particularly when a part of the device is made of transparent material, or by using an indicator light. The left-hand and right-hand compartments 20, 30 each may have a transport mechanism 900, 800; the central compartment 10 may have an elevator mechanism 400 and a transport mechanism 700, and one or more card level or presence sensors. The elevator mechanism 400 may be a component which serves to change the vertical disposition of the central compartment with respect to the side compartments. Alternatively, the central compartment may be fixed in vertical position, and right-hand and left-hand compartments may be changed in vertical position. The central compartment 10 may also include a manual or automatic mechanism to extend the cards outwards from a side or from the top for used access. Alternatively, one of the side compartments may be adapted to dispense the cards to a user.

Figure 15A:
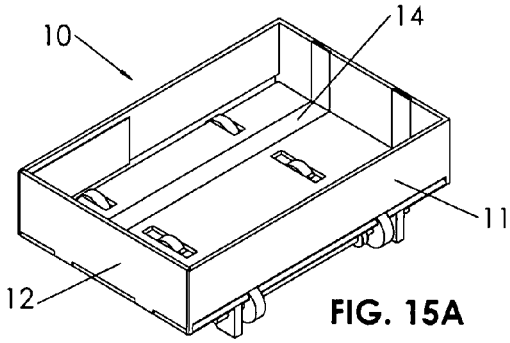
FIG. 15 shows three examples of a card access mechanism: (A) manual; (B) spring actuated; and, (C) rack and pinion.
Figure 15B:
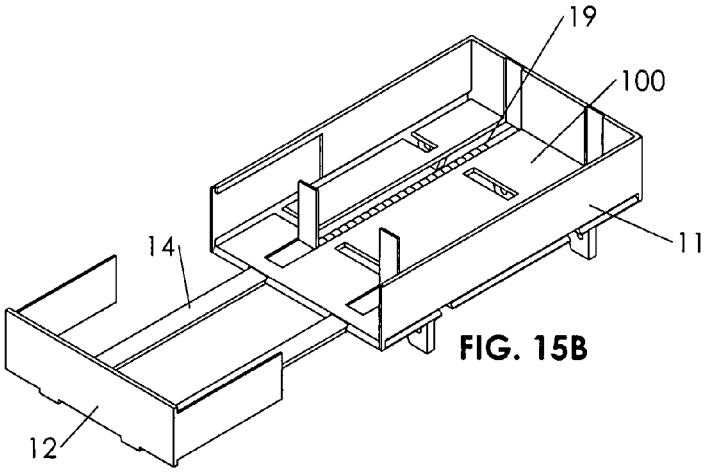
Figure 15C:
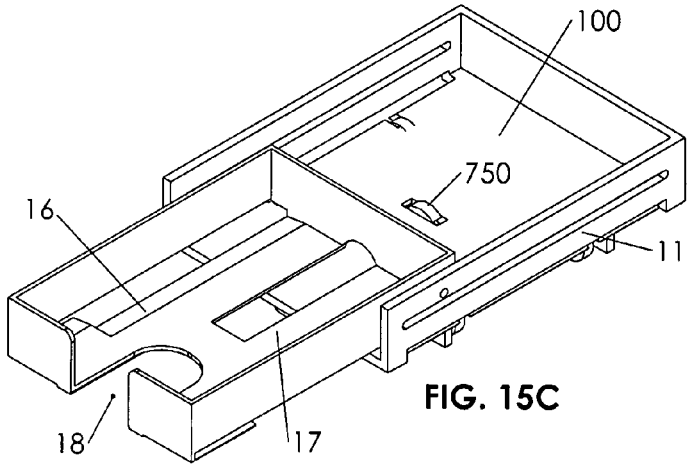

FIG. 15 illustrates a detail of a compartment, which may be the central compartment 10, and which may provide for convenient access to the central compartment 10 for the purpose of introducing a deck of cards 90 into the automatic card shuffling apparatus 1. FIG. 15 A illustrates a manually operated access mechanism. One end 12 of the central compartment 10 is fabricated such that it is not joined the sides 11 of the central compartment, but is slidably secured to the bottom surface 100 of the central compartment 10. Pulling on the end 12 causes the end to slidably move outward, guided and restrained by slides 14 engaging with the bottom 100 of the central compartment. FIG. 15 B shows the situation where the end has been slid outward so that the deck cards may be accessed. In the arrangement of FIG. 15 B, the slides 14 and end 12 have been urged outward by a spring 19, which is compressed when the end 12 is in the closed position. Any of a number of known latch mechanisms may be used to restrain the end 12 in a closed position. Another example of a card accessing mechanism is shown in FIG. 15 C, where the tray has a bottom insert 16 having a rack gear disposed on the underside thereof. The rack gear engages with a motor-driven pinion gear (not shown) and the motor may be operated to extend or retract the bottom insert 16.

In a method of shuffling cards, an apparatus is provided, including a left-hand compartment, a right-hand compartment and a central compartment. The central compartment is adapted to dispense cards into at least one of the left-hand or right-hand compartments, and the left-hand and the right-hand compartments are adapted to dispense cards into the central compartment. After a deck of cards is placed in, or transferred to, the central compartment, a cutting-stripping-riffling (shuffling) operation may be initiated either by an operator pressing a button, or by the device sensing a deck of cards being placed in a compartment thereof. In a cutting-riffling method, the deck of cards is dispensed from the central compartment into the left-hand and right-hand compartments in approximately equal numbers, by dispensing a portion of the deck representing approximately half of the cards into the one side compartment and then dispensing the remainder of the cards into the other side compartment. The relative vertical position of the central compartment with respect to the side compartments may be adjusted such that cards in the side compartments may be dispensed into the central compartment. Cards are dispensed from the side compartments such that approximately one card from each of the side compartments is alternately dispensed into the central compartment until the cards in the side compartments are exhausted.

Alternatively, the central compartment and the side compartments may be disposed in a staggered cascaded arrangement.

In another method of shuffling cards, a stripping-riffling operation may be performed similarly to that of the cutting-riffling operation, where the stripping operation may be considered as a modification of the cutting operation. Rather than dispensing approximately half of the deck from the central compartment into, for example, the right-hand compartment, a number of cards, but less than half of the deck is dispensed into the right-hand compartment. Next, a number of cards, but less than half of the deck, is dispensed into the left-hand compartment. This process is continued until there are no cards remaining in the central compartment. The method continues from the state in the method previously described, where the cutting step has been performed.

The various steps in this method may be performed in an order other than that described above, and various combinations and repetitions of the elemental steps may be performed.

It will be appreciated that this recitation of elements and functionalities is intended to convey an appreciation for the types of elements and functionalities which may be present, however not all of the elements and functionalities may be found in a specific embodiment, and other elements or functionalities may be used repetitively. Ancillary equipment such as a power supply, which may be batteries, a AC-DC converter (battery eliminator), an AC power supply, or the like, are not shown as they are well known to persons of ordinary skill in the art, as are the various types of motors, display and control interfaces.

Although the present invention has been explained by way of the examples described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A device for shuffling a deck of cards, comprising:

a first compartment having a planar dimension sized to accommodate a card of the deck of cards in a horizontal orientation, the first compartment having a plurality of vertical side walls fixedly attached to a substantially horizontal bottom surface, and a slot formed at the bottom of a pair of opposing pair of the plurality of side walls; the first compartment further having a top aperture through which the cards are introduced; the slot in the side walls being dimensioned such that cards of the deck of cards are capable of being propelled through the slot substantially at one time;

a second compartment and a third compartment, each of the second and the third compartment having a planar dimension sized to accommodate the card of the deck of cards in a horizontal orientation, the second and third compartments having a plurality of vertical side walls attached to a substantially horizontal bottom surface, a slot formed at the bottom of the one of the plurality of the side walls, and an top aperture, the top aperture having horizontal dimensions sized to accommodate a face of the card and disposed so as to oppose the bottom surface; the slot being dimensioned such that a cards of the deck of cards are capable of being propelled through the slot substantially at one time;

a first transport mechanism mounted underneath and attached to the bottom surface of the first compartment and having a portion projecting into the first compartment, operative to move a card from a bottom of cards of the deck of cards, when such cards are present in the first compartment, to at least one of the second compartment or the third compartment, the cards being held against the projecting portion of the first transport mechanism by a force of gravity;

a second transport mechanism and a third transport mechanism mounted underneath the bottom surface of the second compartment and the third compartment, respectively, and having a portion projecting into the respective second compartment and the third compartment, operative to move a card from a bottom of the cards of the deck of cards present in the respective second compartment and third compartment to the first compartment, the cards being held against the projecting portion of the second transport mechanism and third transport mechanism by the force of gravity;

wherein the first the second and the third compartments are disposed such that the slots of the second and the third compartment are capable of dispensing cards of the deck of cards present in each compartment to the first compartment through the respective slots in the second and third compartment facing the first compartment into which the cards are dispensed, the slots in the second and third compartments are such that the cards enter the first compartment through the top aperture thereof; and, when the first compartment is operative to dispense cards into either of the second compartment or the third compartment, the slot in the first compartment facing the second compartment or the third compartment higher than the top aperture of the second or third compartment, such that the cards enter the either second or the third compartment through the top aperture thereof.

2. The device of claim 1, wherein the first compartment, including the first transport mechanism is raised and lowered by an elevator mechanism such that the slots in the first compartment are higher than the top apertures of the second compartment and the third compartment when cards are being dispensed from the first compartment, and the slot in each of the second and third compartment is higher than the top aperture of the first compartment when cards are being dispensed from either one of the second and third compartments into the first compartment.

3. The device of claim 1, wherein the first compartment is disposed laterally between the second and the third compartments.

4. The device of claim 3, wherein the first compartment is movable vertically with respect to the second and third compartments and the second and third compartments are fixed in a vertical direction.

5. The device of claim 3, wherein the second and third compartments are movable vertically with respect to the first compartment, and the first compartment is fixed in a vertical direction.

6. The device of claim 1, wherein the movement of at least one of the compartments is effected by an elevator mechanism.

7. The device of claim 6, wherein the elevator mechanism is one of a cam and cam follower, a scissors jack, a belt drive, or a rack and pinion gear.

8. The device of claim 6, wherein the first compartment is held against a cam by a spring when the first compartment has been displaced vertically with respect to the second and third compartments.

9. The device of claim 6, wherein the elevator mechanism includes a belt drive and a pulley, and the first compartment, or the second and third compartments, are fixedly attached to the belt drive.

10. The device of claim 9, wherein the belt drive has a toothed surface for engaging at least one pulley having a surface conforming to the toothed surface.

11. The device of claim 1, wherein the first, the second, and the third transport mechanisms are controlled by a processor executing a stored computer program.

12. The device of claim 11, wherein the computer program is stored on a non-volatile machine readable medium.

13. The device of claim 1, wherein a protrusion is located at the top of at least one of the first, the second, or the third compartment so that cards dispensed into the compartment are deflected downward.

14. The device of claim 13, wherein the protrusion is resilient.

15. The device of claim 1, wherein each transport mechanism further comprises a roller projecting through a slot in a bottom surface of the corresponding compartment, wherein the axis of the roller is orthogonal to the direction in which cards are dispensed.

16. The device of claim 15, wherein each transport mechanism further includes a cylindrical device having a segment removed therefrom along a radial direction, the cylindrical device having a axis parallel to the roller axis and displaced orthogonally therefrom, and the cylindrical device projects through the bottom surface of the compartment so that when the cylindrical device is rotated about the axis, a radially oriented surface thereof lifts at least one of the cards in the compartment and urges the card towards an aperture of the compartment.

17. The device of claim 16, wherein the roller and the cylindrical device are rotated by a motor operating through at least one of a gear drive or a belt drive.

18. The device of claim 1, wherein the cards being dispensed are counted by an electro-optical or electromechanical counter.

19. The device of claim 1, where the presence of cards in a compartment is sensed by an electro-optical or electromechanical device.

20. The device of claim 1, where the transfer of cards between compartments is sensed by an electro-optical or electromechanical device.

21. The device of claim 1, wherein one of the first, second or third compartments is operable to extend at least a portion thereof outside an enclosure surface so that a plurality of cards may be introduced into, or removed from, the extended compartment.

* * * * *

UNITED STATES PATENT AND TRADEMARK OFFICE

CERTIFICATE OF CORRECTION

PATENT NO. : 7,900,923 B2
APPLICATION NO. : 11/706707
DATED : March 8, 2011
INVENTOR(S) : Toyama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 206 days.

Signed and Sealed this
Fourteenth Day of June, 2011

David J. Kappos

David J. Kappos
*Director of the United States Patent and Trademark Office*